US007905066B2

(12) United States Patent
Pryor et al.

(10) Patent No.: US 7,905,066 B2
(45) Date of Patent: Mar. 15, 2011

(54) AUTOMATIC TAKE-UP DEVICE AND IN-LINE COUPLER

(75) Inventors: Steven E. Pryor, Dublin, CA (US); Lisa M. McGurty, Livermore, CA (US); William F. Leek, Carmel, CA (US); Richard I. Proctor, San Rafeal, CA (US)

(73) Assignee: Simpson STrong-Tie Co., Inc., Pleasanton, CA (US)

( * ) Notice: Subject to any disclaimer, the term of this patent is extended or adjusted under 35 U.S.C. 154(b) by 12 days.

(21) Appl. No.: 11/697,683

(22) Filed: Apr. 6, 2007

(65) Prior Publication Data

US 2008/0245004 A1 Oct. 9, 2008

(51) Int. Cl.

| | |
|---|---|
| ***E04C 5/08*** | (2006.01) |
| ***F16B 43/00*** | (2006.01) |
| ***F16C 11/00*** | (2006.01) |
| ***F16F 1/14*** | (2006.01) |
| ***E04G 23/00*** | (2006.01) |
| ***E04B 1/343*** | (2006.01) |
| ***E04C 3/00*** | (2006.01) |

(52) U.S. Cl. ..... 52/223.14; 52/291; 52/573.1; 52/849; 411/536; 403/111; 403/146; 403/293; 267/154

(58) Field of Classification Search ..... 52/848, 52/849, 293.3, 295, 223.1, 573.1, 223.14, 52/291, 1; 403/111, 146, 149, 166, 229, 403/286, 292, 293, 296, 298; 411/536, 432, 411/433; 267/273, 275, 178, 179, 291, 154
See application file for complete search history.

(56) References Cited

U.S. PATENT DOCUMENTS

| | | | |
|---|---|---|---|
| 179,994 | A | 7/1876 | Brallier |
| 487,721 | A | 12/1892 | De Kalb |
| 518,165 | A | 4/1894 | Thalaker |

(Continued)

FOREIGN PATENT DOCUMENTS

| | | |
|---|---|---|
| CA | 2313735 | 7/2000 |

(Continued)

OTHER PUBLICATIONS

McGraw-Hill Book Company, Inc., "Product Engineering Design Manual" edited by Douglas C. Greenwood, (New York), copyright 1959, (Title and copyright page, pp. 90-97, 316-329).

(Continued)

*Primary Examiner* — Richard E Chilcot, Jr.
*Assistant Examiner* — Mark R. Wendell
(74) *Attorney, Agent, or Firm* — James R. Cypher; Charles R. Cypher

(57) ABSTRACT

A tension connection for a building includes a first tension member, the first tension member being anchored at its distal end, a second tension member being anchored at its distal end; the first and second tension members being disposed in close proximity and connected by a coupler having a surrounding sleeve and a central bore with a thread, the coupler also being formed with a first rotational member being received in the central bore of the surrounding sleeve and operatively connected to the surrounding sleeve; the first rotational member is connected to the surrounding sleeve, such that the rotational member can rotate in relation to the surrounding sleeve. A torsion spring connects the first rotational member and the surrounding sleeve; the torsion spring biasing the first rotational member and the surrounding sleeve in opposite rotational directions such that the first rotational member can be drawn into the surrounding sleeve.

34 Claims, 15 Drawing Sheets

U.S. PATENT DOCUMENTS

| | | | | | |
|---|---|---|---|---|---|
| 560,554 | A | | 5/1896 | Wiestner | |
| 581,551 | A | | 4/1897 | Green | |
| 582,424 | A | | 5/1897 | Hunt | |
| 807,021 | A | | 12/1905 | Falk | |
| 856,868 | A | | 6/1907 | Heffner | |
| 1,344,417 | A | | 6/1920 | Lovekin | |
| 1,347,687 | A | | 7/1920 | Ellis et al. | |
| 1,374,713 | A | | 4/1921 | Bell | |
| 1,435,028 | A | * | 11/1922 | Stewart | 403/286 |
| 1,589,307 | A | | 6/1926 | Svebilius | |
| 1,737,543 | A | | 11/1929 | Mason | |
| 1,746,978 | A | | 2/1930 | Winkler | |
| 1,867,296 | A | | 7/1932 | Woodruff | |
| 1,953,354 | A | | 4/1934 | Holland-Letz | |
| 1,966,780 | A | | 7/1934 | Wyrick | |
| 2,021,051 | A | | 11/1935 | Desbrueres | |
| 2,066,541 | A | | 1/1937 | Schenk | |
| 2,103,601 | A | * | 12/1937 | Stigall | 403/46 |
| 2,261,537 | A | | 11/1941 | Zamara | |
| 2,264,480 | A | * | 12/1941 | Owen | 403/296 |
| 2,294,745 | A | | 9/1942 | Goetz | |
| 2,405,889 | A | | 8/1946 | Kennedy | |
| 2,587,560 | A | * | 2/1952 | Widmer | 411/231 |
| 2,649,625 | A | | 8/1953 | Johnson | |
| 2,650,844 | A | * | 9/1953 | Shemorry | 403/146 |
| 2,685,812 | A | | 8/1954 | Dmitroff | |
| 2,689,987 | A | * | 9/1954 | Berger | 52/293.3 |
| 2,690,682 | A | * | 10/1954 | Passman | 74/441 |
| 2,896,496 | A | | 7/1959 | Jansen | |
| 3,021,794 | A | * | 2/1962 | Knox | 417/454 |
| 3,104,645 | A | | 9/1963 | Harrison | |
| 3,115,804 | A | | 12/1963 | Johnson | |
| 3,118,681 | A | | 1/1964 | Fuehrer | |
| 3,153,333 | A | | 10/1964 | Chisholm | |
| 3,157,215 | A | | 11/1964 | Zahodiakin | |
| 3,161,174 | A | | 12/1964 | Harrison | |
| 3,174,386 | A | | 3/1965 | Lewis | |
| 3,187,621 | A | | 6/1965 | Turner | |
| 3,219,373 | A | * | 11/1965 | Sutliff | 403/34 |
| 3,285,120 | A | | 11/1966 | Kartiala | |
| 3,306,154 | A | | 2/1967 | Bailey | |
| 3,325,175 | A | | 6/1967 | Lower | |
| 3,378,891 | A | * | 4/1968 | Metz | 403/371 |
| 3,429,092 | A | | 2/1969 | Perry et al. | |
| 3,440,334 | A | | 4/1969 | Blomstrand | |
| 3,469,492 | A | | 9/1969 | Dahl | |
| 3,476,010 | A | | 11/1969 | Markey | |
| 3,479,897 | A | | 11/1969 | Holthofer | |
| 3,724,151 | A | | 4/1973 | Kaywood | |
| 3,728,933 | A | * | 4/1973 | Grube | 411/5 |
| 3,764,157 | A | * | 10/1973 | LeBlanc | 280/6.154 |
| 3,782,061 | A | | 1/1974 | Minutoli et al. | |
| 3,844,137 | A | * | 10/1974 | Zugel | 464/78 |
| 3,861,814 | A | * | 1/1975 | Fisher | 403/300 |
| 3,878,757 | A | | 4/1975 | Puklus, Jr. | |
| 3,948,141 | A | | 4/1976 | Shinjo | |
| 4,000,681 | A | | 1/1977 | Coldren | |
| 4,011,397 | A | * | 3/1977 | Bouche | 174/42 |
| 4,020,734 | A | | 5/1977 | Bell | |
| 4,037,516 | A | | 7/1977 | Hart | |
| 4,047,463 | A | | 9/1977 | Coldren | |
| 4,055,875 | A | | 11/1977 | Strickland | |
| 4,146,951 | A | * | 4/1979 | Howlett | 29/452 |
| 4,149,446 | A | | 4/1979 | Spengler et al. | |
| 4,249,426 | A | * | 2/1981 | Erikson et al. | 74/441 |
| 4,286,482 | A | | 9/1981 | Marsch et al. | |
| 4,403,561 | A | * | 9/1983 | Schaeflern et al. | 112/237 |
| 4,433,879 | A | | 2/1984 | Morris | |
| RE31,713 | E | * | 10/1984 | Erikson et al. | 74/441 |
| 4,479,747 | A | | 10/1984 | Pagel | |
| 4,604,014 | A | | 8/1986 | Frano | |
| 4,665,672 | A | | 5/1987 | Commins et al. | |
| 4,703,711 | A | | 11/1987 | Haynes | |
| 4,708,555 | A | | 11/1987 | Terry | |
| 4,720,223 | A | | 1/1988 | Neights et al. | |
| 4,729,703 | A | | 3/1988 | Sato | |
| 4,761,860 | A | | 8/1988 | Krauss | |
| 4,801,231 | A | * | 1/1989 | Everman | 411/432 |
| 4,812,096 | A | * | 3/1989 | Peterson | 411/231 |
| 4,848,454 | A | * | 7/1989 | Spears | 166/108 |
| 4,850,777 | A | * | 7/1989 | Lawrence et al. | 411/433 |
| 4,875,314 | A | | 10/1989 | Boilen | |
| 4,887,948 | A | | 12/1989 | Calmettes | |
| 4,896,985 | A | | 1/1990 | Commins | |
| 4,909,012 | A | | 3/1990 | Thompson, Jr. et al. | |
| 4,919,122 | A | * | 4/1990 | Kohlenbrenner | 52/223.7 |
| 4,922,771 | A | | 5/1990 | Campbell | |
| 4,936,843 | A | | 6/1990 | Sohngen | |
| 4,954,032 | A | * | 9/1990 | Morales | 411/289 |
| 4,979,857 | A | | 12/1990 | Wing | |
| 5,015,132 | A | | 5/1991 | Turner et al. | |
| 5,056,764 | A | * | 10/1991 | Mochizuki | 267/291 |
| 5,081,811 | A | | 1/1992 | Sasaki | |
| 5,168,681 | A | | 12/1992 | Ayrapetyan | |
| 5,180,268 | A | | 1/1993 | Richardson | |
| 5,197,176 | A | | 3/1993 | Reese | |
| 5,199,835 | A | | 4/1993 | Turner | |
| 5,207,543 | A | | 5/1993 | Kirma | |
| 5,228,250 | A | | 7/1993 | Kesselman | |
| 5,249,404 | A | | 10/1993 | Leek et al. | |
| 5,254,016 | A | | 10/1993 | Ganthier | |
| 5,265,326 | A | | 11/1993 | Scribner | |
| 5,308,184 | A | * | 5/1994 | Bernard | 403/305 |
| 5,316,319 | A | | 5/1994 | Suggs | |
| 5,340,258 | A | | 8/1994 | Simon | |
| 5,364,214 | A | | 11/1994 | Fazekas | |
| 5,365,715 | A | | 11/1994 | Steinmetz et al. | |
| 5,370,483 | A | | 12/1994 | Hood et al. | |
| 5,379,563 | A | | 1/1995 | Tinsley | |
| 5,384,993 | A | * | 1/1995 | Phillips | 52/92.2 |
| 5,386,748 | A | | 2/1995 | Kilgore | |
| 5,411,347 | A | * | 5/1995 | Bowmer et al. | 403/305 |
| 5,487,632 | A | | 1/1996 | Hood et al. | |
| 5,505,026 | A | | 4/1996 | Fausto | |
| 5,522,688 | A | * | 6/1996 | Reh | 411/536 |
| 5,531,054 | A | | 7/1996 | Ramirez | |
| 5,535,561 | A | | 7/1996 | Schuyler | |
| 5,540,530 | A | | 7/1996 | Fazekas | |
| 5,570,549 | A | * | 11/1996 | Lung et al. | 52/295 |
| 5,582,496 | A | * | 12/1996 | Ambrico et al. | 411/432 |
| 5,606,839 | A | | 3/1997 | Baumann | |
| 5,664,389 | A | | 9/1997 | Williams | |
| 5,704,572 | A | | 1/1998 | Vogel et al. | |
| 5,718,090 | A | * | 2/1998 | Wei-Hwang | 52/223.14 |
| 5,722,645 | A | * | 3/1998 | Reitter | 267/177 |
| 5,729,952 | A | * | 3/1998 | Dahl | 403/269 |
| 5,743,670 | A | * | 4/1998 | Ader | 403/296 |
| 5,769,581 | A | | 6/1998 | Wallace et al. | |
| 5,782,048 | A | | 7/1998 | Ramirez | |
| 5,815,999 | A | | 10/1998 | Williams | |
| 5,829,531 | A | | 11/1998 | Hebert et al. | |
| 5,839,321 | A | * | 11/1998 | Siemons | 74/441 |
| 5,885,034 | A | | 3/1999 | Fergusson | |
| 5,906,361 | A | * | 5/1999 | Carranza | 267/162 |
| 5,931,618 | A | | 8/1999 | Wallace et al. | |
| 5,967,691 | A | * | 10/1999 | Lancelot, III | 403/313 |
| 5,979,130 | A | | 11/1999 | Gregg et al. | |
| 5,987,828 | A | | 11/1999 | Hardy | |
| 6,019,556 | A | | 2/2000 | Hess | |
| 6,068,250 | A | | 5/2000 | Hawkins et al. | |
| 6,073,642 | A | * | 6/2000 | Huang | 135/114 |
| 6,099,196 | A | * | 8/2000 | Lancelot, III | 403/313 |
| 6,120,723 | A | | 9/2000 | Butler | |
| 6,135,687 | A | | 10/2000 | Leek et al. | |
| 6,139,113 | A | | 10/2000 | Seliga | |
| 6,151,850 | A | * | 11/2000 | Sorkin | 52/223.13 |
| 6,158,188 | A | | 12/2000 | Shahnazarian | |
| 6,161,339 | A | * | 12/2000 | Cornett et al. | 52/23 |
| 6,161,350 | A | | 12/2000 | Espinosa | |
| 6,167,785 | B1 | | 1/2001 | Penner | |
| 6,168,455 | B1 | | 1/2001 | Hussaini | |
| 6,176,051 | B1 | * | 1/2001 | Sorkin | 52/223.13 |
| 6,192,647 | B1 | * | 2/2001 | Dahl | 403/300 |
| 6,195,949 | B1 | * | 3/2001 | Schuyler | 52/223.13 |
| 6,250,041 | B1 | | 6/2001 | Seccombe | |
| 6,256,960 | B1 | | 7/2001 | Babcock et al. | |
| 6,279,877 | B1 | * | 8/2001 | Davis | 254/134.3 FT |

| | | | | |
|---|---|---|---|---|
| 6,282,994 | B1 | 9/2001 | Wei | |
| 6,327,829 | B1 * | 12/2001 | Taguchi | 52/583.1 |
| 6,327,831 | B1 | 12/2001 | Leek | |
| 6,367,205 | B2 * | 4/2002 | Cornett, Sr. | 52/23 |
| 6,390,747 | B1 * | 5/2002 | Commins | 411/536 |
| 6,494,654 | B2 | 12/2002 | Espinosa | |
| 6,513,290 | B2 | 2/2003 | Leek | |
| 6,585,469 | B2 * | 7/2003 | Commins | 411/536 |
| 6,679,024 | B2 * | 1/2004 | Dahl | 403/265 |
| 6,688,058 | B2 * | 2/2004 | Espinosa | 52/293.3 |
| 6,688,071 | B1 * | 2/2004 | Evers et al. | 403/307 |
| 6,745,649 | B1 | 6/2004 | Liao | |
| 6,773,002 | B2 * | 8/2004 | Adoline et al. | 267/168 |
| 6,773,198 | B2 * | 8/2004 | Copping | 403/313 |
| 6,925,773 | B2 * | 8/2005 | Gregel et al. | 403/265 |
| 7,037,060 | B2 * | 5/2006 | Commins | 411/536 |
| 7,150,132 | B2 * | 12/2006 | Commins | 52/293.3 |
| 7,287,355 | B2 * | 10/2007 | Commins | 52/223.14 |
| 7,467,787 | B2 * | 12/2008 | Adoline et al. | 267/291 |
| 2001/0002524 | A1 * | 6/2001 | Espinosa | 52/293.3 |
| 2001/0002529 | A1 | 6/2001 | Commins et al. | |
| 2001/0037611 | A1 | 11/2001 | Cornett, Sr. | |
| 2002/0020137 | A1 | 2/2002 | Commins | |
| 2002/0066246 | A1 * | 6/2002 | Leek | 52/295 |
| 2002/0092383 | A1 | 7/2002 | Nezigane | |
| 2002/0094231 | A1 * | 7/2002 | Lee | 403/166 |
| 2002/0114664 | A1 * | 8/2002 | Gregel et al. | 403/305 |
| 2003/0230032 | A1 * | 12/2003 | Shahnazarian et al. | 52/167.3 |
| 2005/0097843 | A1 * | 5/2005 | Giesel et al. | 52/223.1 |
| 2005/0284057 | A1 * | 12/2005 | Commins | 52/295 |
| 2006/0000318 | A1 | 1/2006 | Hsieh | |
| 2006/0133912 | A1 | 6/2006 | Commins | |
| 2008/0060296 | A1 * | 3/2008 | Espinosa | 52/293.3 |
| 2008/0060297 | A1 * | 3/2008 | Espinosa | 52/293.3 |
| 2008/0099968 | A1 * | 5/2008 | Schroeder | 267/166 |

FOREIGN PATENT DOCUMENTS

| | | |
|---|---|---|
| GB | 383460 | 11/1932 |
| GB | 1099472 | 1/1968 |
| GB | 1384511 | 2/1975 |
| GB | 2262583 A * | 6/1993 |
| JP | 46-1521 | 1/1971 |
| SU | 706586 | 12/1979 |
| SU | 796498 | 1/1981 |

OTHER PUBLICATIONS

Arthur B: Richardson, Declaration of Arthur B. Richardson, executed Dec. 21, 2002, p. 106.

Anchor Tiedown Systems, Inc., "Expansion Jack Washer," Anchor Tiedown System, Inc. Brochure (Mill Valley, CA and Burden, WA), consist of one page, printed one side (1999).

"Device Keeps Shear Walls Tight," p. 49-50, May 18, 2000.

"Thru-Bolt Log Fastening System," Heritage Log Homes, (1999).

"Earthbound Seismis Holdown System Using The "Impasse Device"," Evaluation Report, ICBO Evaluation Service, Inc. (U.S.A.), p. 1-6 (Nov. 1, 1997).

"The Impasse Devise," Inquest Engineering (U.S.A.), (1997).

"LocTite, Automatic Self-Locking Nuts," LocTite (U.S.A. (Oct. 1992).

"Auto Take-Up," Zone Four Engineered Seismic Solutions (U.S.A.), p. 1-4; (2000).

"AT Auto Take-UP,"Zone Four Innovative Engineered Solutions. (Friclay Harbor, WA, U.S.A.), (2001).

"Commins Design LLC," Acceptance Criteria for Shrinkage Compensating Devices and Similar Devices, Proposed ICBO Take-UP Devices Acceptrance Criteria, Draft 1, Dec. 9, 1999, Commins Design LLC (Friday Harbor, WA), total of 3 pages, (Nov. 2, 1999 and Dec. 9, 1999).

Commins Design LLC, "ICBO Evaluation Service Inc. Evaluation Report, ER-XXXX Dec. 10, 1999,"Proposed, 1.0 Subject Commins Desing AT Automatic Take-UP Shrinkage Compensating Devices, Commins Design LLC (Friday Harbor, WA), total of 5 pages, (Dec. 10, 1999).

Commins Design LLC, "AT Auto Take-Up," Shearwall Shrinkage Compensator Solves the Loose Shearwall Problem, Commins Design LLC (Friday Harbor, WA), total of 1 page, (Jan. 3, 200).

Commins Design LLC, "Corivnins Design LLC;"Our Solution to Wood Shrinkage Solves Shearwall Problems, Commins Deign LLC (Friday Harbor, WA), tatal of 2 pages, (Jan. 2000).

Commins; Alfred D., U.S. Appl. No. 60/156,042, titled "Shrinkage Compensator for Budding Tiedowns;" filed Sep. 24, 1999.

Automatic Take-Up Device by Alfred D. Commins, dated Feb. 10, 1998 (5 pages).

Automatic Take-Up Device by Alfred D. Commins, dated Aug. 15, 1996 (7 pages).

Automatic Take-Up Device by Alfred D. Commins, dated Mar. 6, 1996 (3 pages).

Automatic Take-Up Device by Alfred D. Commins, dated Mar. 6, 1996 and Jan. 25, 1996 (5 pages).

Automatic Take-Up Device by Alfred D. Commins, dated Dec. 26, 1995 (3 pages).

Description of Claims raised in *Simpson Manufacturing Co., Inc. and Simpson Strong-Tie Company, Inc.* v. *Alfred D. Commins and Commins Manufacturing, Inc.* (pp. 1 and 2), Submitted Jun. 28, 2010.

Inquest Engineering, Manufacturer's of the Earthbound System, Redefining the State of the Art in Seismic Holdown Technology (U.S.A.) (4 pages), Submitted Jun. 28, 2010.

"ATS- Components", Simpson Strong-Tie Co., Inc., Pleasanton, CA, USA (2 pages), Submitted Jun. 28, 2010.

* cited by examiner

AUTOMATIC TAKE-UP DEVICE AND IN-LINE COUPLER

BACKGROUND OF THE INVENTION

The present invention relates to an automatic take-up coupler. The coupler is adapted for maintaining two structural members in tension. The coupler of the present invention is connected to two elongated tension members and is designed to draw the two elongated tension members together where dimensional changes in the structures occur as in shrinkage of the wood materials.

The device is adapted for maintaining the tension forces between a pair of elongated tension members. The present invention is inserted between two elongated tension members and is designed to allow the ends of the two elongated tension members it connects to draw together, if conditions push the two proximal ends closer to each other or tension on the two ends is reduced.

The present invention is particularly suited for use with tie-down systems used to anchor wood-framed buildings to their foundations. Many such systems use a rod or bolt or an in-line series of rods or bolts that are anchored at their lower end to either a lower member of the building or directly to the foundation of the building. The upper ends of the bolt or rod or the series are connected to a plate or a bracket which, in turn, is connected to or rests upon an upper portion of the building. Intermediate portions or levels of the building may also be connected to the rod or the series of rods. Where the rod or series of rods is connected to the building, the rod or bolt is usually connected to the bracket by means of a nut thread onto the bolt or rod that presses against the plate or bracket. The rod or series of rods is placed in tension by tightening the nut against the plate or bracket that receives the rod or bolt and tensioning any coupling devices between the rods.

Tying elements of the building together with straps or cables is particularly intended to prevent damage or destruction to the building in the event of cataclysmic occurrences such as earthquakes, flooding or high winds. U.S. Pat. No. 573,452, granted Dec. 22, 1896, to Delahunt teaches the use of a standard turnbuckle to connect threaded rods that tie a building to its foundation.

For the rod or series of rods to serve as an effective anchor for the building it is important that the rod or series of rods remain in tension. However, a number of different factors can cause the tie-down system to lose its tension.

One such factor is wood shrinkage. Most lumber used in wood-frame construction has a water content when the building is constructed that is relatively high in comparison to the water content in the lumber after the building has been assembled. Once the envelope of the building is completed, the lumber is no longer exposed to the relatively humid outside air, and it begins to lose moisture which leads to shrinkage. A standard 2×4 can shrink by as much as 1/16" of an inch across its grain within the first two years that it is incorporated in a building.

Delahunt '452 taught that as wood building structural members shrink during the life of the building, the cables will go slack and lose their ability to hold the wood members together. The turnbuckles that coupled the rods together in Delahunt '452 enabled workmen to hand rotate the turnbuckles to tighten the cables connecting the foundation and the roof or to connect wood roof members to other wood roof members. See also Williams, U.S. Pat. No. 5,664,389, granted Sep. 9, 1997, which uses non-adjustable clamps to couple multiple lengths of reinforcing bar to tie a roof structure of a multistory wood frame building to a concrete foundation.

In most wood frame structures, the cables and devices to tighten the cables, such as turnbuckles are buried within the structure after construction is completed. Manually turning the turnbuckles or other devices used to re-tension the cables is an expensive proposition particularly where building panels must be removed to reach the turnbuckles or other tightening devices.

Most of the wood shrinkage occurs during the first couple of years after construction but can continue at a much slower rate for several years. Since any loose connections in the building, during oscillating forces imposed on a building, such as during earthquakes, floods, and high wind, increase the probability of damage or destruction to the building, efforts have been made to tighten the connections by the use of automatic take-up devices.

A wide variety of methods have been proposed to automatically maintain the tension in anchoring rods and bolts used in tie down systems for buildings, so that an operator need not tighten them manually. See, for example: U.S. Pat. No. 5,180,268, granted to Arthur B. Richardson on Jan. 12, 1993; U.S. Pat. No. 5,364,214, granted to Scott Fazekas on Nov. 15, 1994; U.S. Pat. No. 5,522,688, granted to Carter K. Reh on Jun. 4, 1996; or U.S. Pat. No. 5,815,999, granted Oct. 6, 1998 to Williams. These devices are interposed between two work members and expand as the two members separate, maintaining the connection or contact between them. These devices are designed to expand without reversing or contracting once they are installed.

Another approach is taught by U.S. Pat. No. 4,812,096. This patent was granted to Peter O. Peterson on Mar. 14, 1989. In this method, the tension rods are pulled into connecting brackets as the building shrinks and settles, such that the over-all length of the tie-down system is reduced.

The present invention represents an improvement over the prior art methods. The present invention provides a novel take-up tension device that like Peterson '096 reduces the over-all length of the tie-down system as the tension in the in-line rod system attempts to reduce. The present invention is fully adjustable within a certain range of movement and provides a rigid force transmitting mechanism. Certain embodiments of the present invention also provide shielding for some of the working mechanisms of the device from the elements and dirt and grime.

The preferred coupler of the present invention is intended to be used in conjunction with holdowns and continuous tiedowns, as part of a restraint system in a wood or steel frame construction, to remove slack from the system by compensating for shrinkage and/or settlement of the framing. The preferred coupler of the present invention is an in-line coupling device that connects threaded rods together between storey levels, and maintains a tight configuration when shrinkage and/or settlement occurs. The device can be installed at any height in the wall, and is capable of compensating for up to one inch (25 mm) of shrinkage and/or settlement from the storey level above. Reducing couplers allow transitions between different rod diameters. Each end of the coupler is manufactured to create a positive stop for the threaded rod. The coupler has witness holes to allow for inspection of proper thread engagement.

SUMMARY OF THE INVENTION

The present invention consists of a connection, having a first elongated tension member, and a second elongated tension member and a contraction device or coupler that receives the first and second tension members and is loaded in tension by its connection to the first and second structural tension members.

The objective of the present invention is to provide an automatic take-up coupler which is relatively small, relatively inexpensive and easy to install.

Another objective is to provide an automatic take-up coupler which will reliably achieve a selected design tension during a reasonable selected time period in the life of the building.

A still further objective is to provide an automatic take-up coupler which has reduced frictional turning resistance to the take-up action of the device.

DETAILED DESCRIPTION OF THE INVENTION

Figure 1:
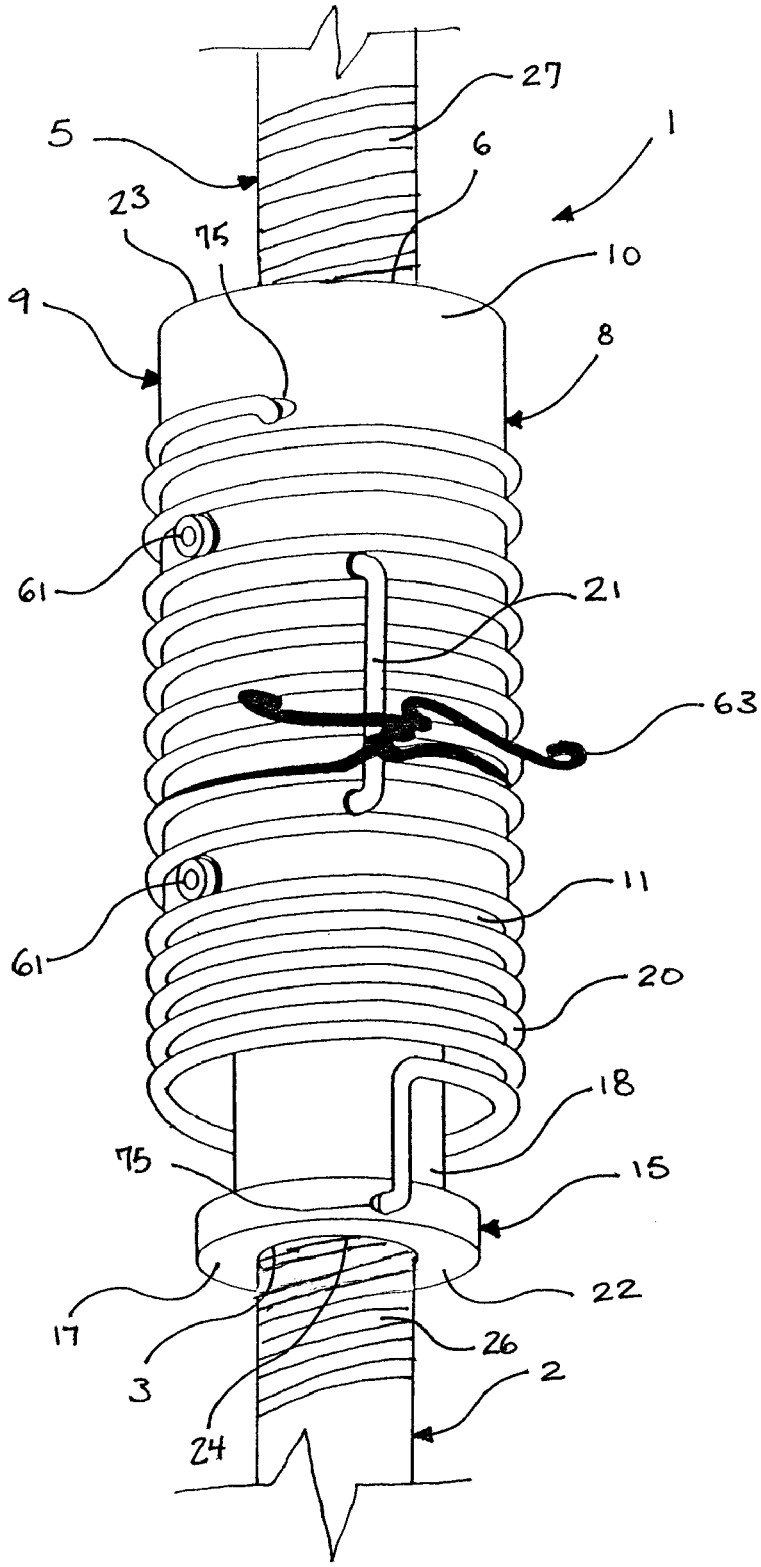
FIG. 1 is a perspective view of a connection formed in accordance with the present invention, utilizing a coupler formed in accordance with the present invention and having a single surrounding sleeve.
Figure 2:
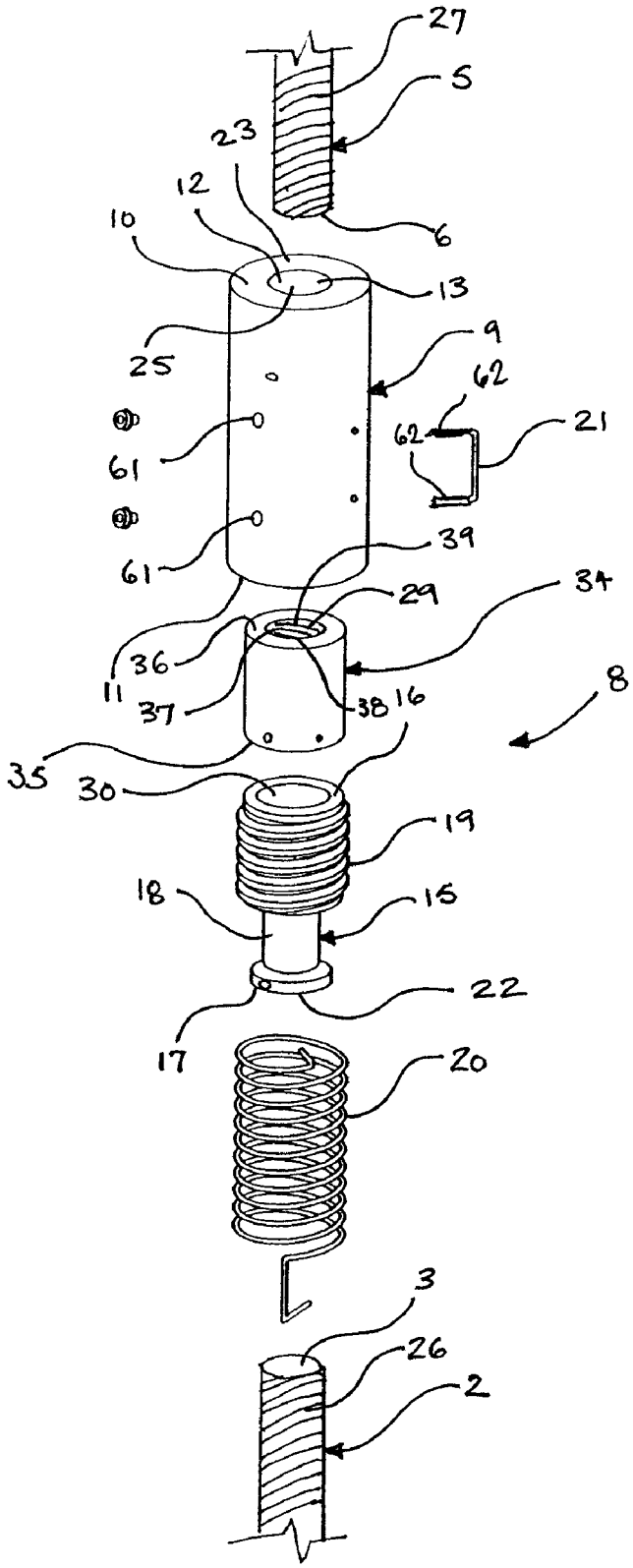
FIG. 2 is an exploded perspective view of a connection formed in accordance with the present invention, utilizing a coupler formed in accordance with the present invention and having a single surrounding sleeve.

As shown in FIG. 1, the coupler 8 of the preferred form of the present invention includes a surrounding sleeve 9, a first rotational member 15, and a torsion spring 20. The preferred coupler 8 compensates for wood shrinkage and settlement due to dead load and construction loading, which occur in continuous tiedown systems, and uplift load path systems in wood and steel framed structures. The preferred coupler 8 is an in-line coupling device that compensates for up to one inch of wood shrinkage and settlement from the level above. The coupler 8 connects threaded rods together between storey levels, and maintains a tight configuration when shrinkage or settlement occurs. The preferred device can be installed at any height in the wall. Reducing couplers 8 allow transition between different rod diameters. The coupler 8 is generally not required to lift dead load.

The torsion spring 20 must have sufficient energy to rotate the surrounding sleeve 9 and the first rotational member 15 so as to be capable of overcoming the friction resistance of the threads.

Furthermore, the torsion spring 20 must be capable of rotating the surrounding sleeve 9 in relation to the first rotational member 15 a sufficient number of times to maintain the design selected tension in the first and second elongated tension members 2 and 5.

Figure 21:
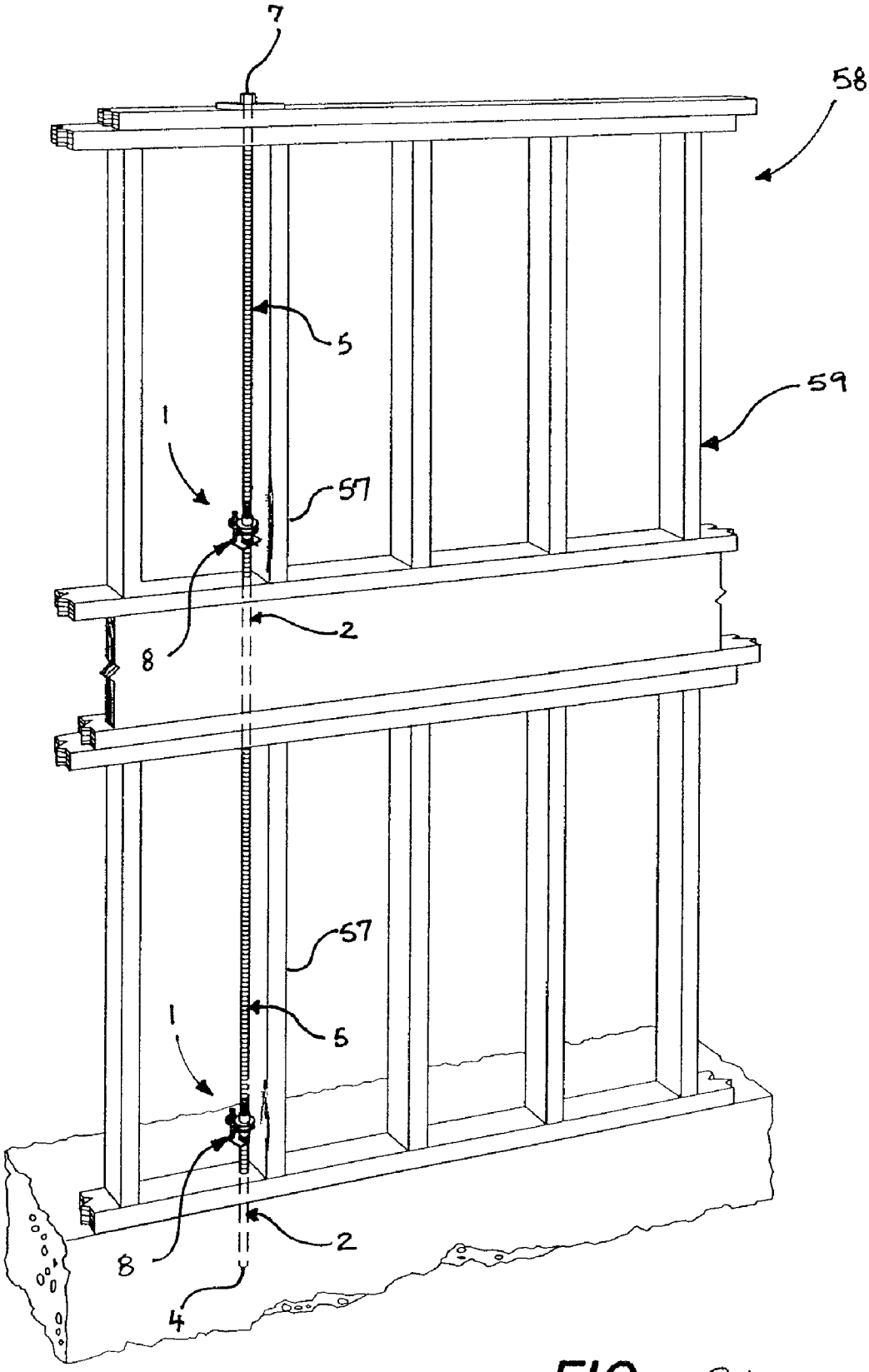
FIG. 21 is a perspective view of a wall showing a pair of connections formed in accordance with the present invention.

As shown in FIG. 21, in the preferred embodiment, the dimension of the coupler 8 is small enough so that the torsion spring 20 may be mounted within the walls of the building 58 or other confined space. The present invention is a connection 1 that includes a first elongated tension member 2, a second elongated tension member 5, and a coupler 8.

Figure 3:
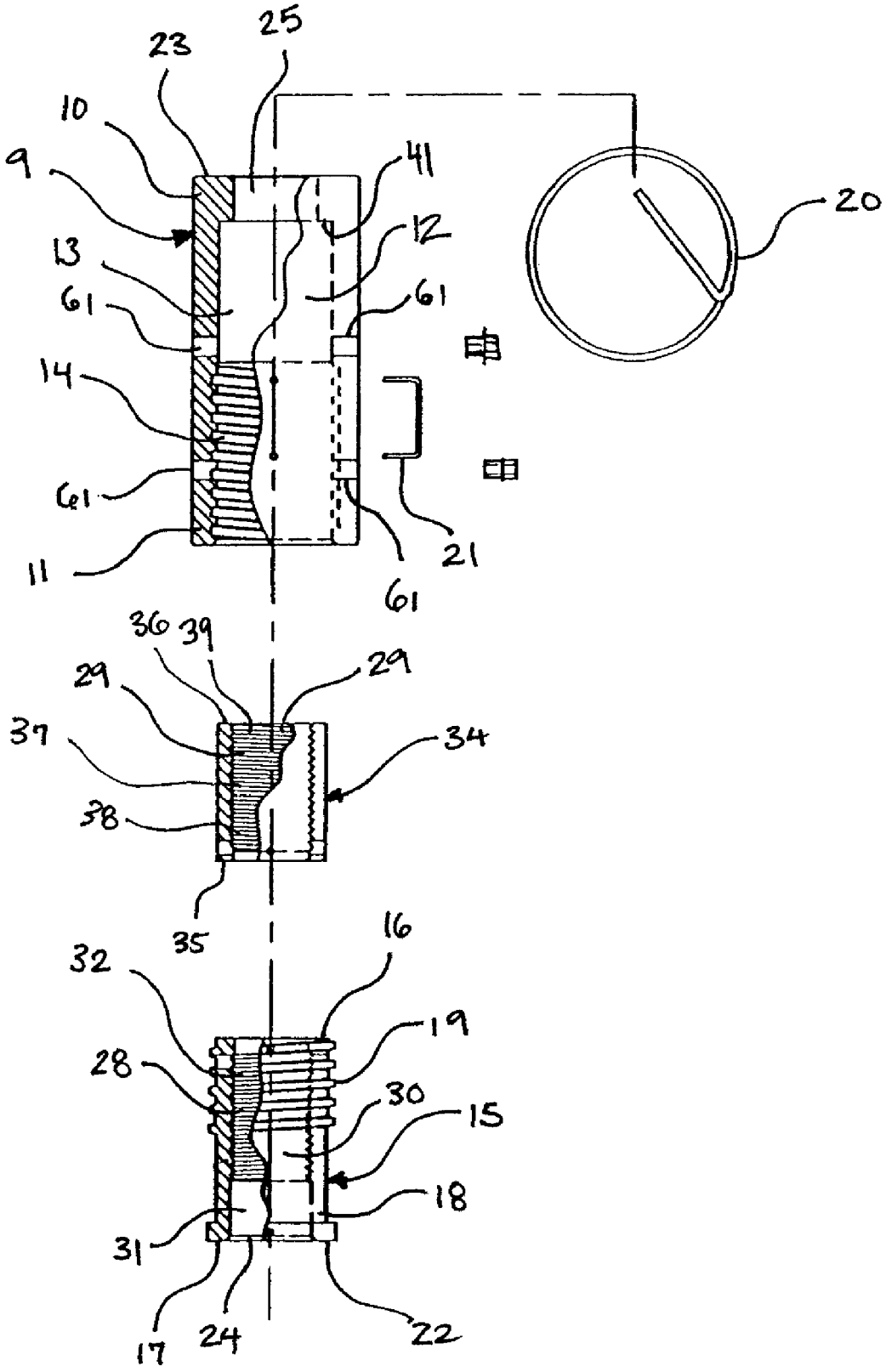
FIG. 3 is an exploded cutaway side elevation view of a coupler formed in accordance with the present invention and having a single surrounding sleeve.

As shown in FIGS. 3 and 21, the first elongated tension member 2 has a proximal end 3 and a distal end 4. The first elongated tension member 2 is anchored at its distal end 4. The first elongated tension member 2 could be anchored in the foundation of the building 59 or it could be attached to another elongated tension member below it by means of a coupler 8 of the present invention. The second elongated tension member 5 has a proximal end 6 and a distal end 7. The second elongated tension member 5 is anchored at its distal end 7. The second elongated tension member 5 could be anchored to a bracket attached to the building 59 or to another elongated tension member above it by means of a coupler 8.

As shown in FIG. 1, the proximal ends 3 and 6 of the first and second elongated tension members 2 and 5 are disposed in close proximity to each other. The coupler 8 is attached to the proximal ends 3 and 6 of the first and second elongated tension members 2 and 5, connecting the first and second elongated tension members 2 and 5 together.

The coupler 8 includes a surrounding sleeve 9, a first rotational member 15, and a torsion spring 20. The surrounding sleeve 9 has a connection end 10 and a take-up end 11, and a central bore 12. At least a portion of the central bore 12 is formed as a substantially cylindrical inner surface 13 and at least a portion of the cylindrical inner surface 13 is formed with a thread 14. The first rotational member 15 has a proximal end 16 and a distal end 17. The first rotational member 15 is received in the central bore 12 of the surrounding sleeve 9 and is operatively connected to the surrounding sleeve 9. The first rotational member 15 has a substantially cylindrical outer surface 18 formed with a thread 19 that mates with the thread 14 of the cylindrical inner surface 13 of the surrounding sleeve 9. The first rotational member 15 is connected to the surrounding sleeve 9 only by the mating attachment of the thread 19 on the cylindrical outer surface 18 with the thread 14 of the surrounding sleeve 9, so that the first rotational member 15 can rotate in relation to the surrounding sleeve 9. The torsion spring 20 connects the first rotational member 15 and the surrounding sleeve 9. The torsion spring 20 biases the first rotational member 15 and the surrounding sleeve 9 in opposite rotational directions so that the first rotational member 15 can be drawn into the surrounding sleeve 9.

As shown in FIG. 1, the torsion spring 20 is attached to the first rotational member 15 and the surrounding sleeve 9 by insertion into spring retaining openings 75 on the first rotational member 15 and the surrounding sleeve 9.

As shown in FIG. 1, preferably, the coupler 8 also includes a locking clip 21 that is releasably attached to the coupler 8. The locking clip 21 holds the surrounding sleeve 9 and the first rotational member 15 in a selected relationship so that the first rotational member 15 cannot travel further into the surrounding sleeve 9. The locking clip 21 thereby prevents the surrounding sleeve 9 and the first rotational member 15 from rotating under the influence of the torsion spring 20 and causing the coupler 8 to contract.

The coupler 8 preferably has a first end 22 and a second end 23, with a first coupling aperture 24 at the first end 22 and a second coupling aperture 25 at the second end 23. The first elongated tension member 2 is inserted in the first coupling aperture 24 and the second elongated tension member 5 is inserted in the second coupling aperture 25.

Preferably, the proximal end 3 of the first elongated tension member 2 is at least partially formed with a thread 26 where the coupler 8 attaches to the first elongated tension member 2. Preferably, the proximal end 6 of the second elongated tension member 5 is at least partially formed with a thread 27 where the coupler 8 attaches to the second elongated tension member 5. Preferably, the coupler 8 attaches to the first and second elongated tension members 2 and 5 by means of a first internally threaded portion 28 accessible through the first coupling aperture 24 and a second internally threaded portion 29 accessible through the second coupling aperture 25. The first and second internally threaded portions 28 and 29 mate with the threads 26 and 27 of the first and second elongated tension members 2 and 5, respectively. In the preferred embodiment, the first and second internally threaded portions 28 and 29 are both formed with positive stops 60 for the threads 26 and 27 of the first and second elongated tension members 2 and 5, so that the first and second elongated tension members 2 and 5 can only enter the coupler 8 a selected distance. This prevents the first and second elongated tension members 2 and 5 from interfering with the ability of the coupler 8 to contract.

Preferably, the first and second elongated tension members 2 and 5 are first and second threaded rods 2 and 5. The first and second threaded rods 2 and 5 are preferably cut square and their design complies with code specifications.

Figure 10:
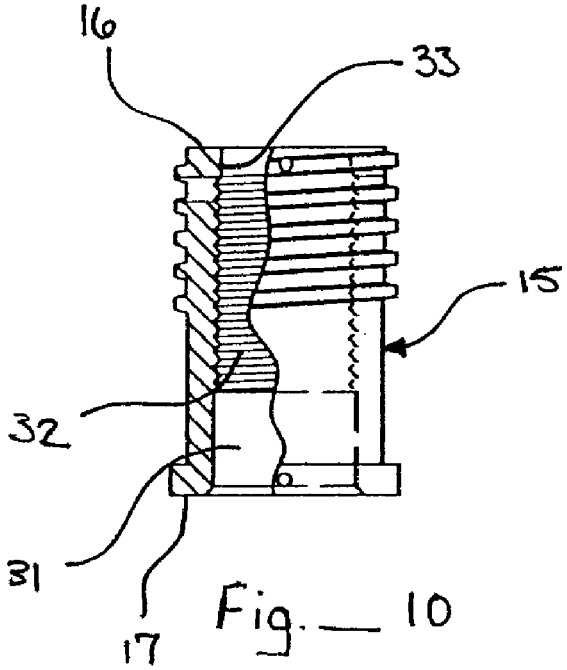
FIG. 10 is a side elevation cutaway view of a first rotational member of a coupler formed in accordance with the present invention and having a single surrounding sleeve.
Figure 11:
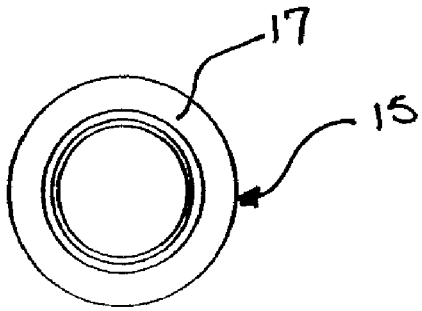
FIG. 11 is a bottom plan view of a first rotational member of a coupler formed in accordance with the present invention and having a single surrounding sleeve.

As shown in FIGS. 1 and 10, the first rotational member 15 preferably has a central cavity 30. At least a portion of the central cavity 30 of the first rotational member 15 is formed as a substantially cylindrical inner surface 31. At least a portion of the cylindrical inner surface 31 is formed with an internal thread 32. Preferably, the internal thread 32 of the cylindrical inner surface 31 of the first rotational member 15 receives the thread 26 of the proximal end 3 of the first elongated tension member 2.

The internal thread 19 of the first rotational member, 15 near the proximal end 16 of the first rotational member 15, is preferably disturbed so that it is not possible for the proximal end 3 of the first elongated tension member 2, traveling on the internal thread 19, to travel past a selected point 33 near the proximal end 16 of the first rotational member 15.

As shown in FIGS. 1, 3, 7 and 8, preferably, a second end connection member 34 is received at least partially inside the central bore 12 of the surrounding sleeve 9 and is operatively connected to the surrounding sleeve 9. The second end connection member 34 preferably has a proximal end 35 and a distal end 36, and a central cavity 37. At least a portion of the central cavity 37 is formed as a substantially cylindrical inner surface 38 and at least a portion of the cylindrical inner surface 38 is formed with an internal thread 39. Preferably, the internal thread 39 of the cylindrical inner surface 38 of the second end connection member 34 receives the thread 27 of the proximal end 6 of the second elongated tension member 5.

Figure 5:
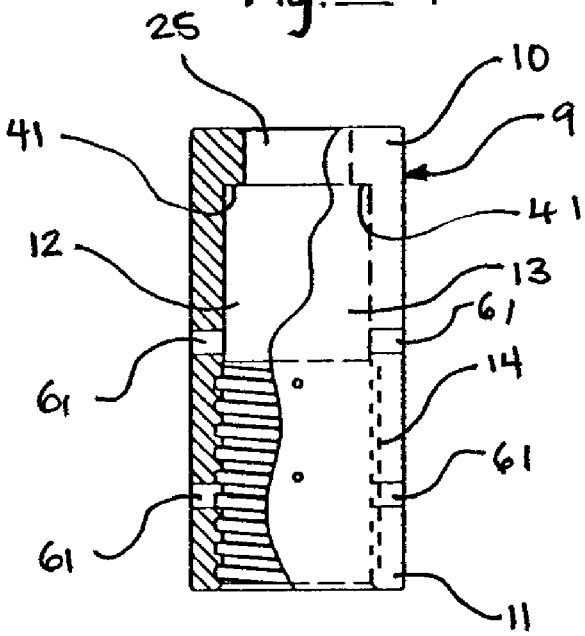
FIG. 5 is a side elevation cutaway view of a surrounding sleeve of a coupler formed in accordance with the present invention and having a single surrounding sleeve.
Figure 6:
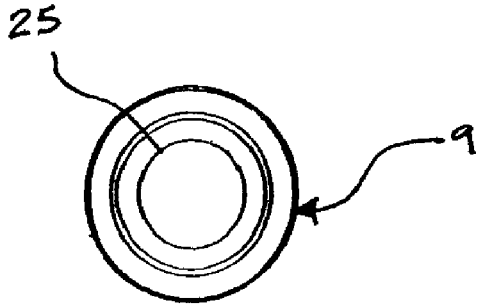
FIG. 6 is a bottom plan view of a surrounding sleeve of a coupler formed in accordance with the present invention and having a single surrounding sleeve.
Figure 7:
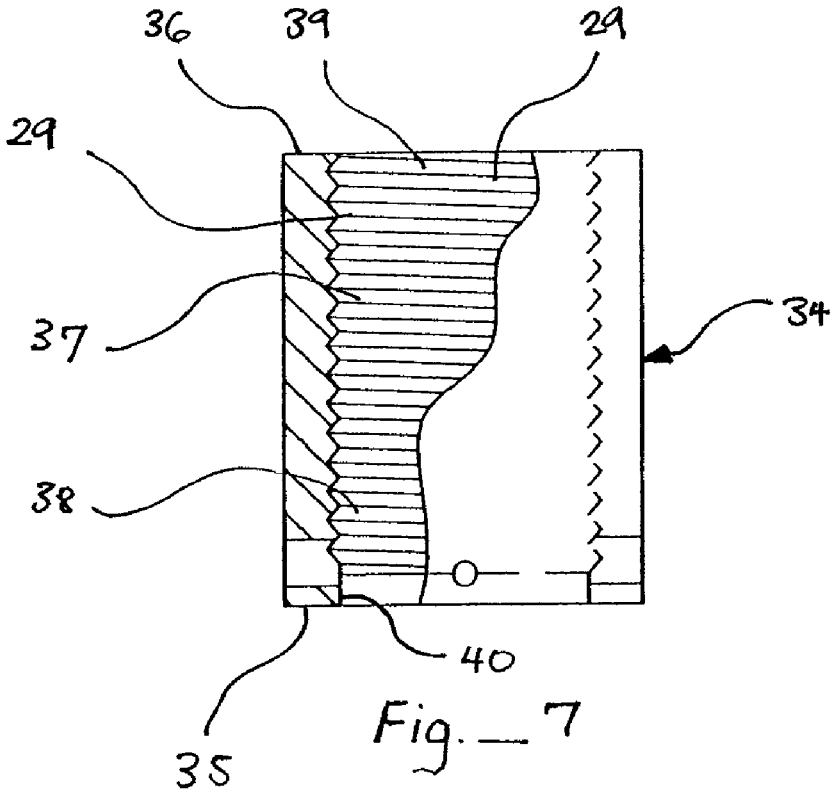
FIG. 7 is a side elevation view of a second end connection member of a coupler formed in accordance with the present invention and having a single surrounding sleeve.
Figure 8:
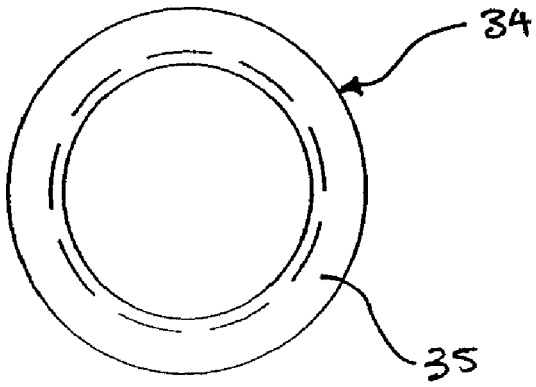
FIG. 8 is a bottom plan view of a second end connection member of a coupler formed in accordance with the present invention and having a single surrounding sleeve.
Figure 9:
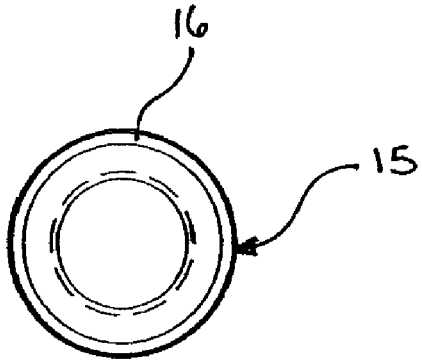
FIG. 9 is a top plan view of a first rotational member of a coupler formed in accordance with the present invention and having a single surrounding sleeve.

The internal thread 39 of the second end connection member 34, near the proximal end 35 of the second end connection member 34, is preferably disturbed so that it is not possible for the proximal end 6 of the second elongated tension member 5, traveling on the internal thread 39, to travel past a selected point 40 near the proximal end 35 of the internal thread 39. As shown in FIG. 5, preferably, the second end connection member 34 is prevented from withdrawing from the connection end 10 of the surrounding sleeve 9 by a shoulder 41 on the surrounding sleeve 9.

The second end connection member 34 preferably has a substantially cylindrical outer surface 42 where it is received within the surrounding sleeve 9 and the second end connection member 34 can freely rotate within the surrounding sleeve 9. Preferably, the second end connection member 34 is completely received within the surrounding sleeve 9.

In an alternate embodiment of the present invention shown in FIGS. 12-16, the connection 1 can be formed with a coupler 8 that also includes a supplemental surrounding sleeve 43 and a second torsion spring 49. The supplemental surrounding sleeve 43 has a connection end 44 and a take-up end 45, and a central bore 46. At least a portion of the central bore 46 is formed as a substantially cylindrical inner surface 47 and at least a portion of the cylindrical inner surface 47 is formed with a thread 48.

The distal end 17 of the first rotational member 15 is received in the central bore 46 of the supplemental surrounding sleeve 43 and is operatively connected to the supplemental surrounding sleeve 43. The first rotational member 15 has a substantially cylindrical outer surface 18 formed with a thread 19 that mates with the thread 48 of the cylindrical inner surface 47 of the supplemental surrounding sleeve 43. The first rotational member 15 is connected to the supplemental surrounding sleeve 43 only by the mating attachment of the thread 19 on the cylindrical outer surface 18 with the thread 48 of the supplemental surrounding sleeve 43, so that the first rotational member 15 can rotate in relation to the supplemental surrounding sleeve 43. The second torsion spring 49 connects the first rotational member 15 and the supplemental surrounding sleeve 43. The torsion spring 49 biases the first rotational member 15 and the supplemental surrounding sleeve 43 in opposite rotational directions so that the first rotational member 15 can be drawn into the supplemental surrounding sleeve 43.

Figure 16:
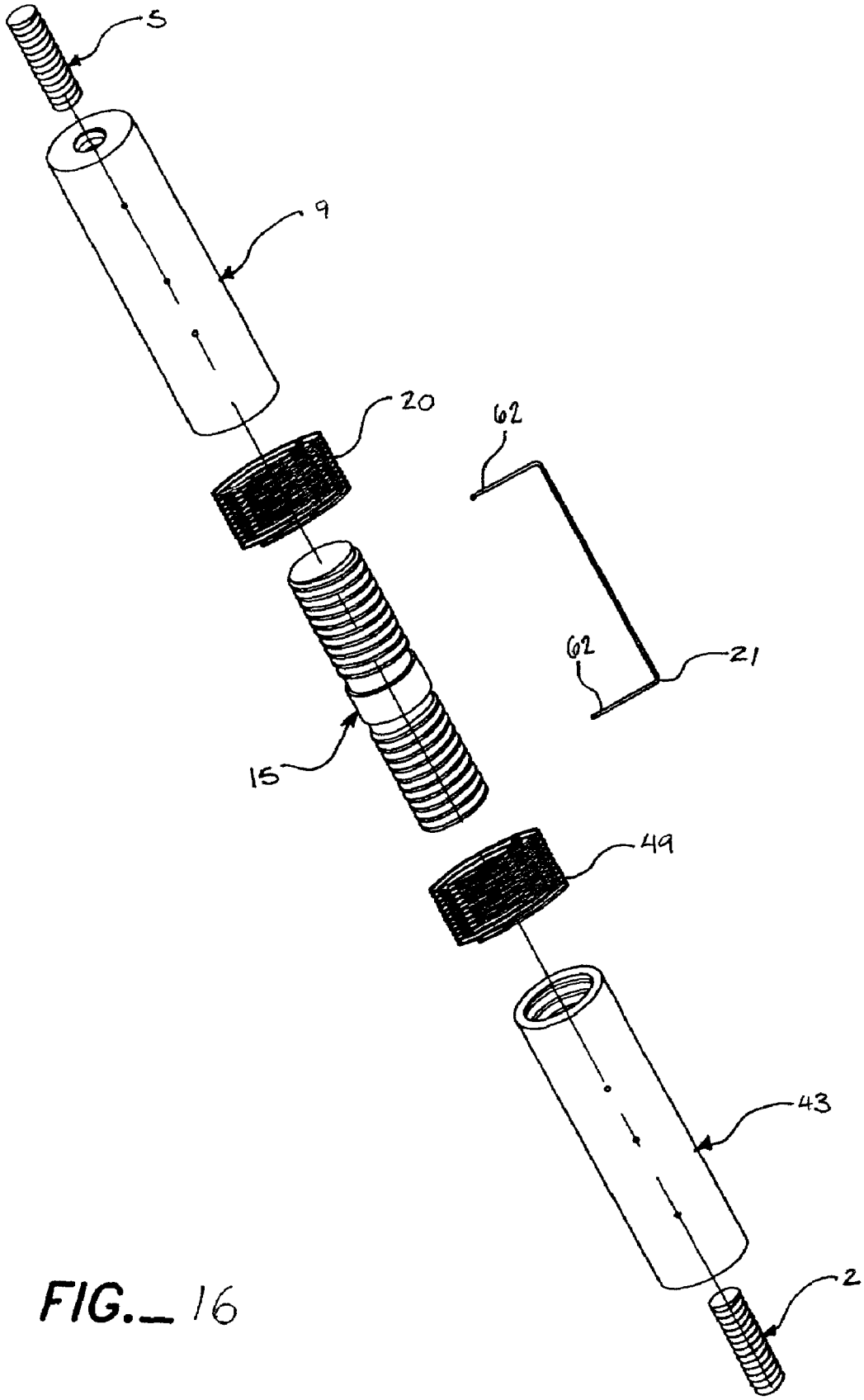
FIG. 16 is an exploded perspective view of a connection formed in accordance with the present invention, utilizing a coupler formed in accordance with the present invention and having two surrounding sleeves.

As best shown in FIG. 16, in this embodiment of the present invention the thread 19 on the first rotational member 15 that mates with thread 48 of the supplemental surrounding sleeve 43 is oppositely threaded to the thread 19 on the first rotational member 15 that mates with the thread 14 of the surrounding sleeve 9.

Figure 14:
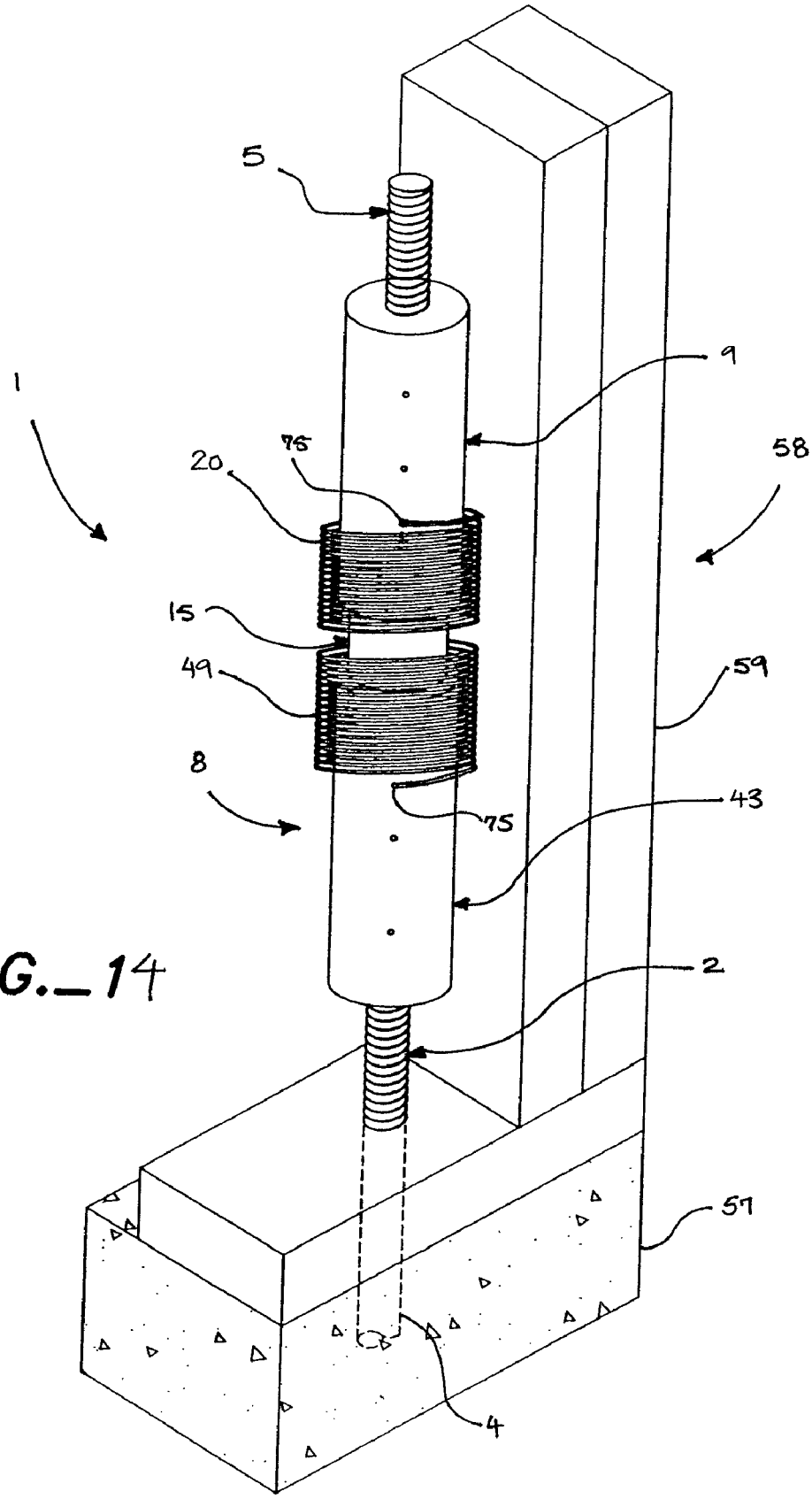
FIG. 14 is a perspective view of a connection formed in accordance with the present invention, utilizing a coupler formed in accordance with the present invention and having two surrounding sleeves.
Figure 15:
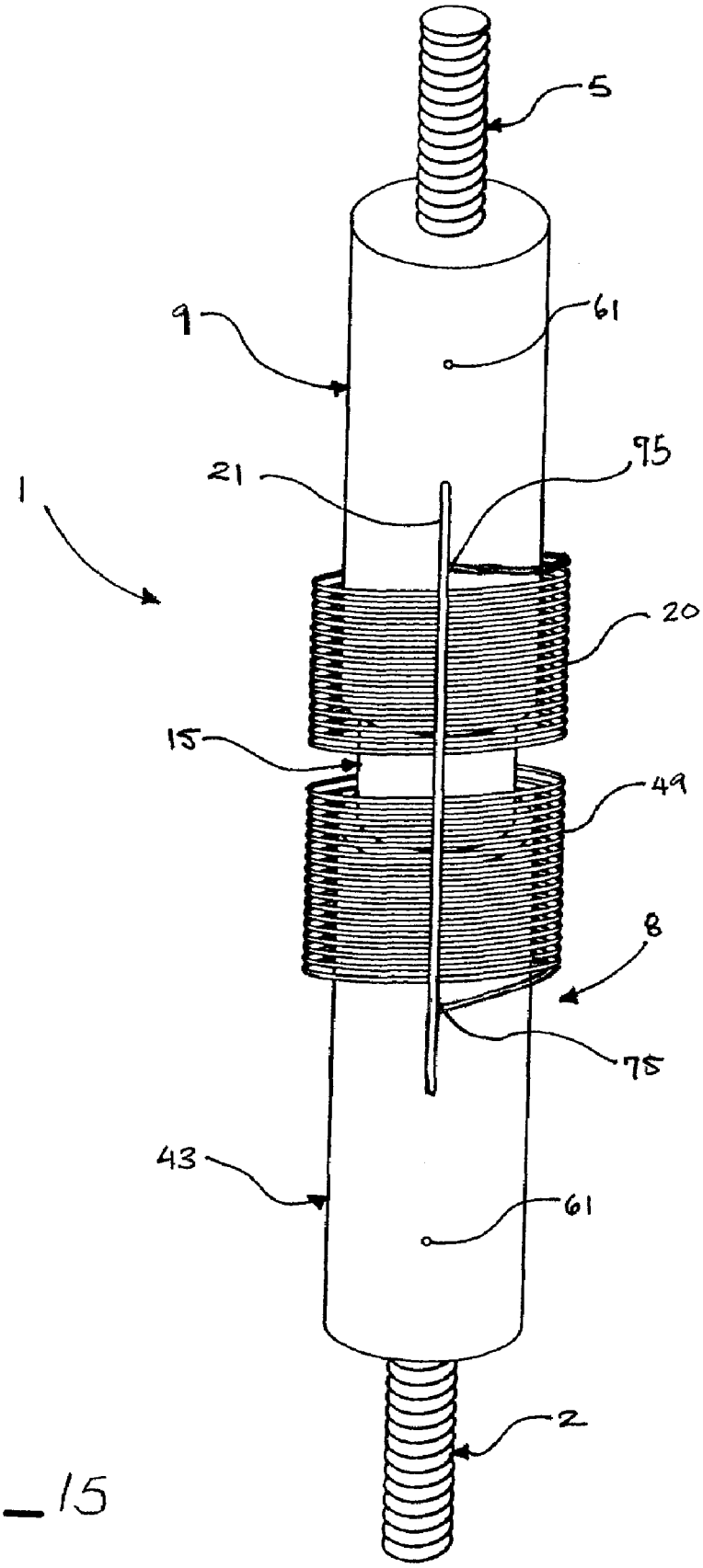
FIG. 15 is a perspective view of a connection formed in accordance with the present invention, utilizing a coupler formed in accordance with the present invention and having two surrounding sleeves.

As shown in FIG. 14, the torsion springs 20 and 49 are attached to the first rotational member 15 and the surrounding sleeve 9 by insertion into spring retaining openings 75 on the first rotational member 15 and the surrounding sleeve 9 and the supplemental surrounding sleeve 43.

Figure 12:
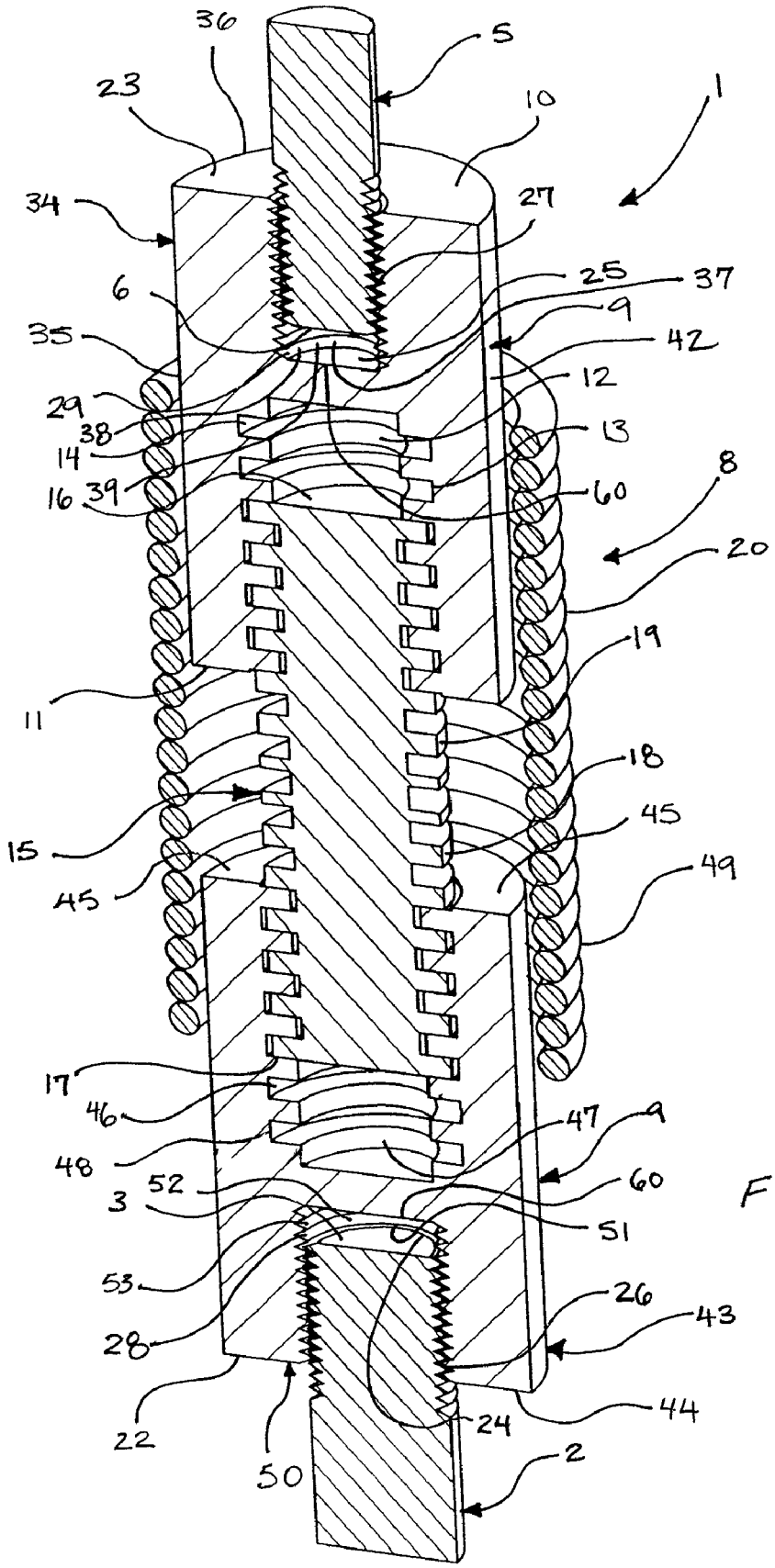
FIG. 12 is a perspective cross-section of a connection formed in accordance with the present invention, utilizing a coupler formed in accordance with the present invention and having two surrounding sleeves.
Figure 13:
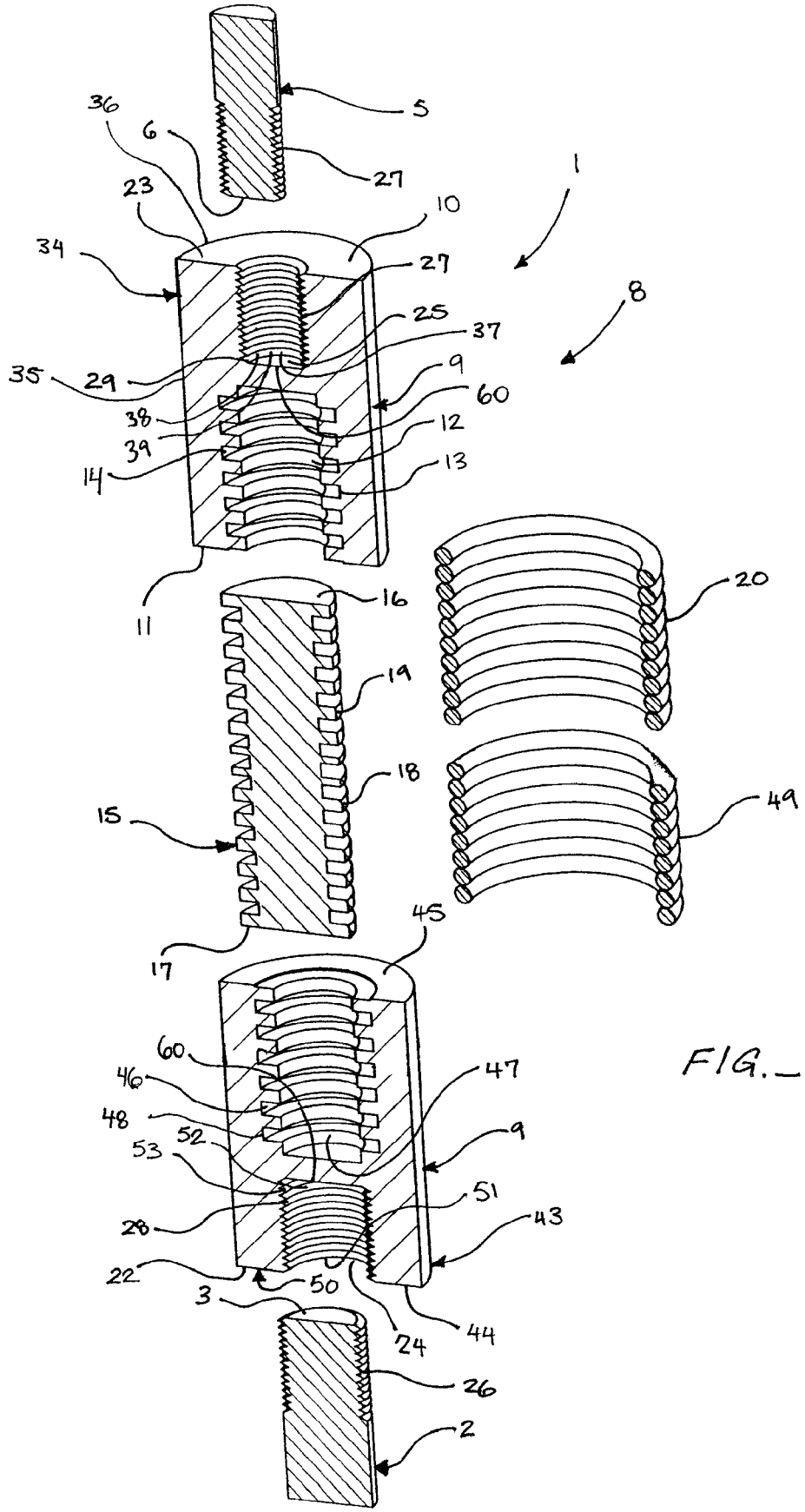
FIG. 13 is an exploded perspective cross-section of a connection formed in accordance with the present invention, utilizing a coupler formed in accordance with the present invention and having two surrounding sleeves.

As shown in FIG. 12, preferably, in this embodiment, the coupler 8 has a first end 22 and a second end 23, a first coupling aperture 24 at the first end 22 and a second coupling aperture 25 at the second end 23. The first elongated tension member 2 is inserted in the first coupling aperture 24 and the second elongated tension member 5 is inserted in the second coupling aperture 25.

The proximal end 3 of the first elongated tension member 2 is preferably at least partially formed with a thread 26 where the coupler 8 attaches to the first elongated tension member 2. The proximal end 6 of the second elongated tension member 5 is preferably at least partially formed with a thread 27 where the coupler 8 attaches to the second elongated tension member 5. The coupler 8 preferably attaches to the first and second elongated tension members 2 and 5 by means of a first internally threaded portion 28 on the first coupling aperture 24 and a second internally threaded portion 29 on the second coupling aperture 25. The first and second internally threaded portions 28 and 29 mate with the threads 26 and 27 of the first and second elongated tension members 2 and 5, respectively.

As shown in FIG. 12, preferably, the supplemental surrounding sleeve 43 is provided with a first end connection member 50 and the first end connection member 50 has a central cavity 51. At least a portion of the central cavity 51 is formed as a substantially cylindrical inner surface 52 and at least a portion of the cylindrical inner surface 52 is formed with an internal thread 53.

The internal thread 53 of the cylindrical inner surface 52 of the first end connection member 50 preferably receives the thread 26 of the proximal end 3 of the first elongated tension member 2. Preferably, the surrounding sleeve 9 is provided with a second end connection member 34.

The second end connection member 34 preferably has a proximal end 35 and a distal end 36, and a central cavity 37. At least a portion of the central cavity 37 is formed as a substantially cylindrical inner surface 38 and at least a portion of the cylindrical inner surface 38 is formed with an internal thread 39. Preferably, the internal thread 39 of the cylindrical inner surface 38 of the second end connection member 34 receives the thread 27 of the proximal end 6 of the second elongated tension member 5.

Figure 17:
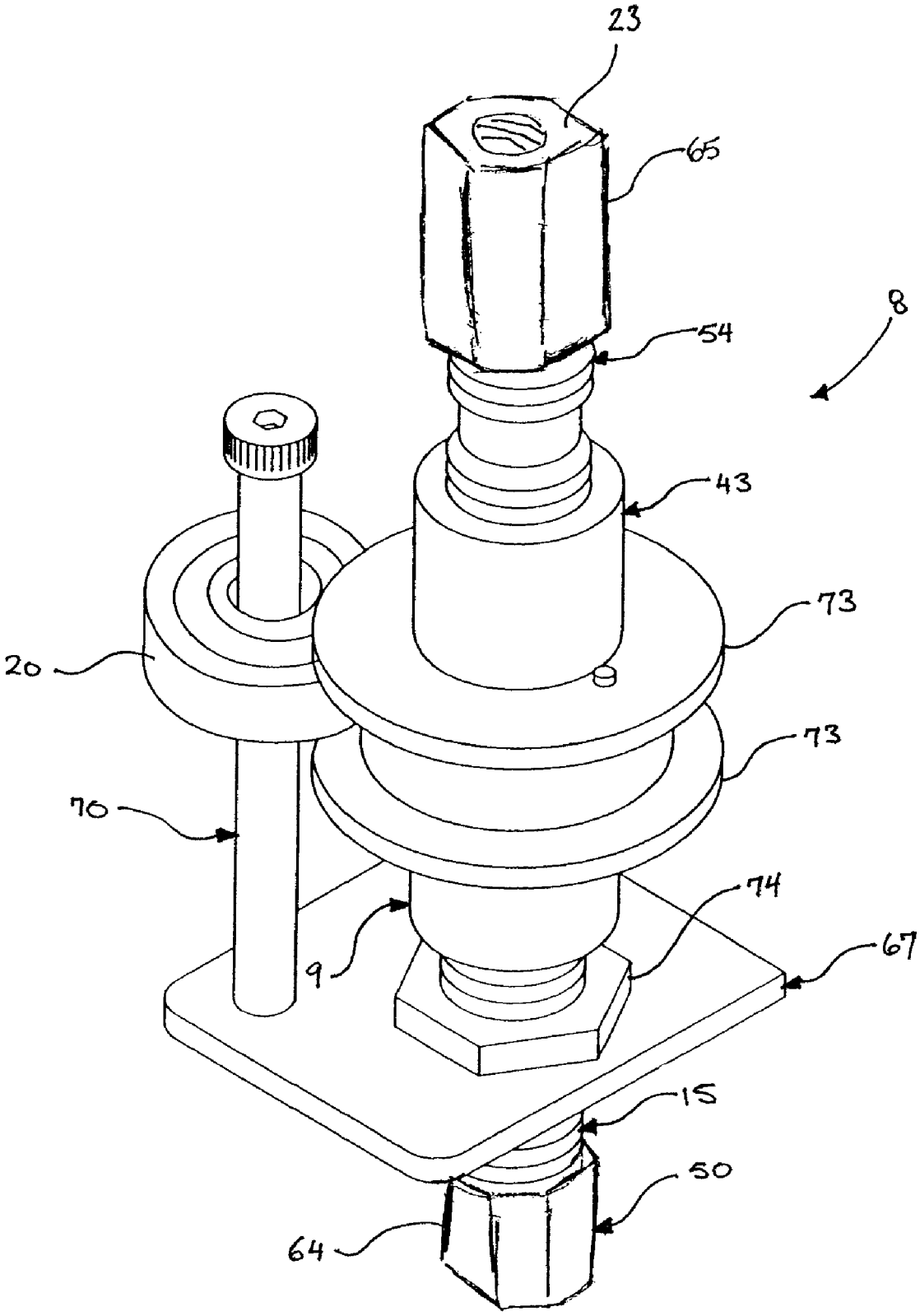
FIG. 17 is a perspective view of a connection formed in accordance with the present invention, utilizing a coupler formed in accordance with the present invention and having two rotational members.
Figure 18:
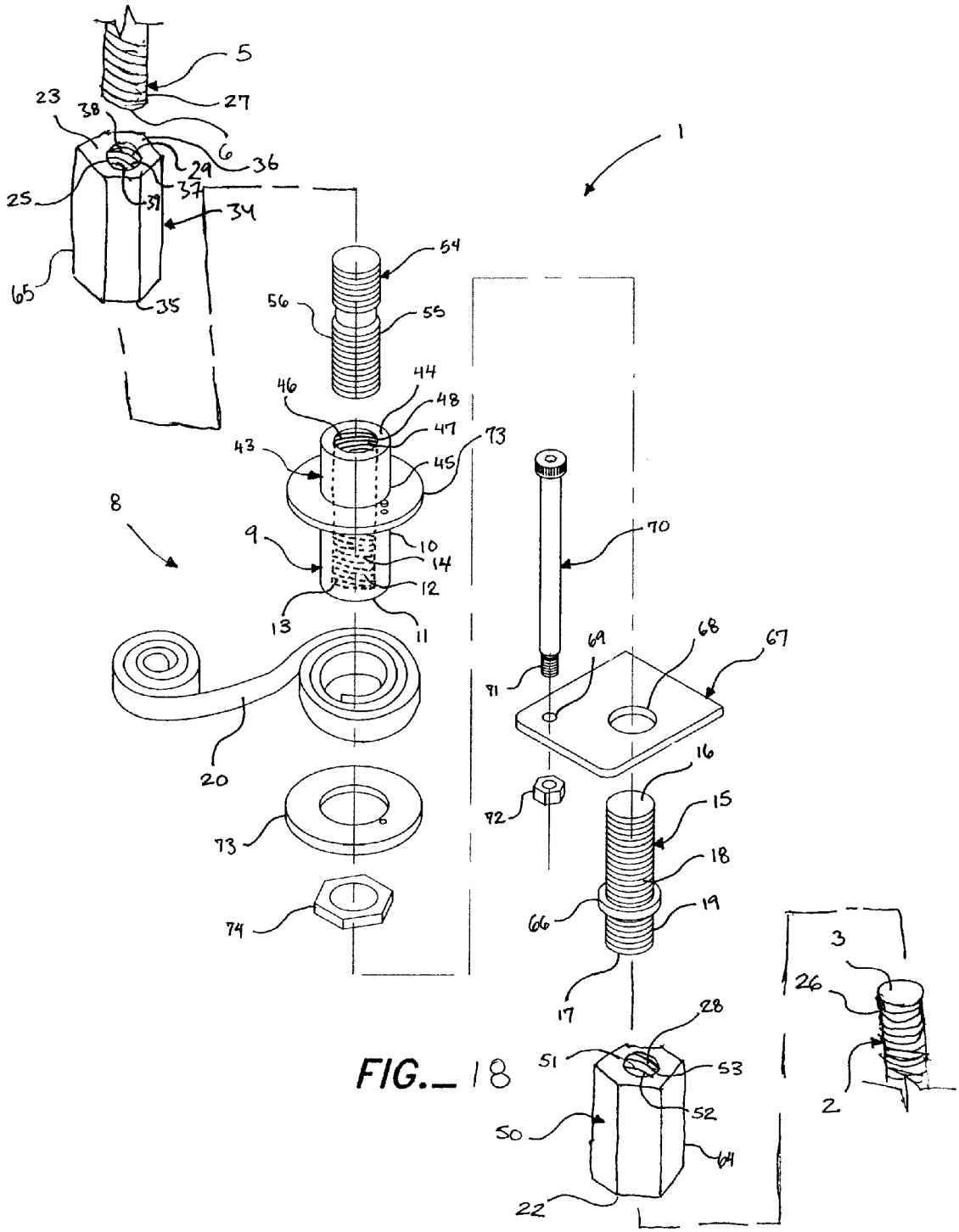
FIG. 18 is an exploded perspective view of the connection shown in FIG. 17, utilizing a coupler formed in accordance with the present invention and having two rotational members.
Figure 19:
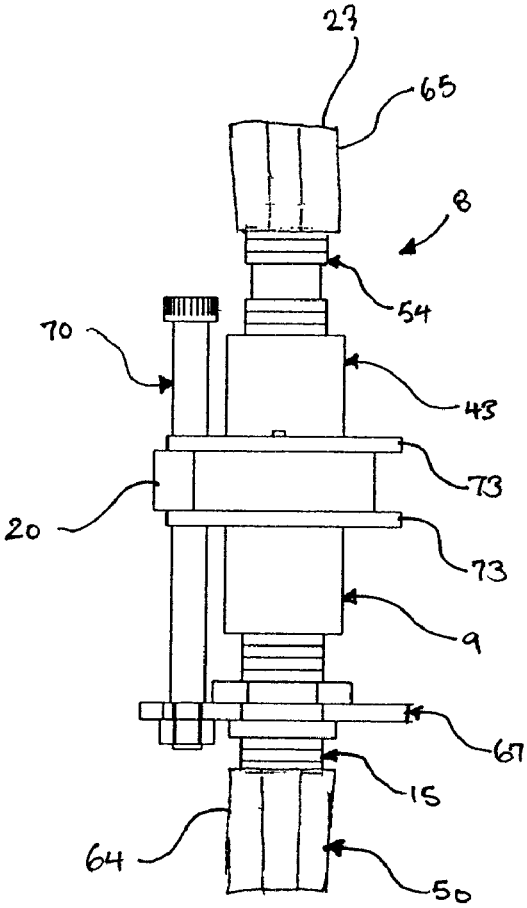
FIG. 19 is a side elevation view of the connection shown in FIG. 17, utilizing a coupler formed in accordance with the present invention and having two rotational members.
Figure 20:
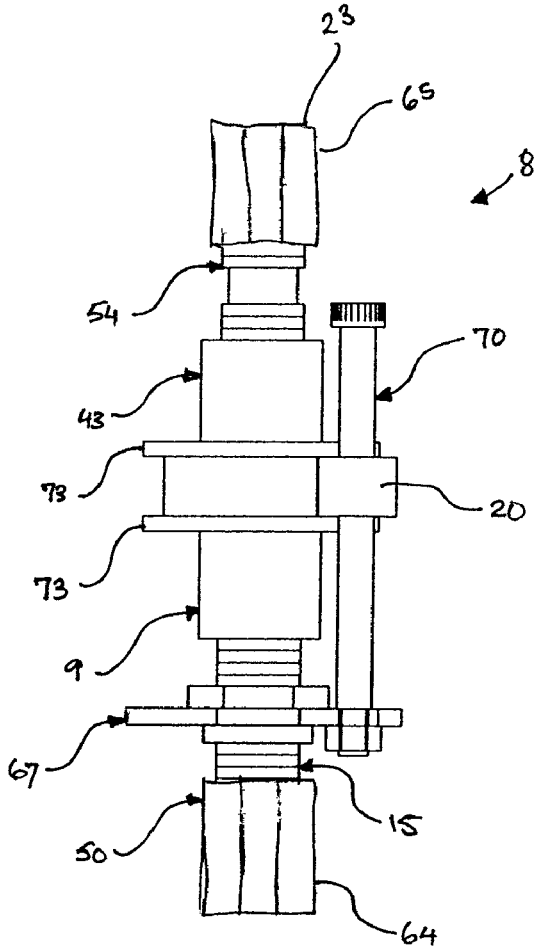
FIG. 20 is a side elevation view of the connection shown in FIG. 17, utilizing a coupler formed in accordance with the present invention and having two rotational members.

In an alternate embodiment of the present invention shown in FIGS. 17-20, the connection 1 can be formed with a coupler 8 that also includes a supplemental surrounding sleeve 43 and a second rotational member 54. As shown in FIG. 18, in this alternate embodiment, the supplemental surrounding sleeve 43 is connected to the surrounding sleeve 9. The supplemental surrounding sleeve 43 has a connection end 44 and a take-up end 45, and a central bore 46. At least a portion of the central bore 46 is formed as a substantially cylindrical inner surface 47 and at least a portion of the cylindrical inner surface 47 is formed with a thread 48.

As shown in FIGS. 17 and 18, in this embodiment, the second rotational member 54 is received in the central bore 46 of the supplemental surrounding sleeve 43 and is operatively connected to the supplemental surrounding sleeve 43. The second rotational member 54 has a substantially cylindrical outer surface 55 formed with a thread 56 that mates with the thread 48 of the cylindrical inner surface 47 of the supplemental surrounding sleeve 43. The second rotational member 54 is connected to the supplemental surrounding sleeve 43 only by the mating attachment of the thread 56 on the cylindrical outer surface 55 with the thread 48 of the supplemental surrounding sleeve 43, so that the second rotational member 54 can rotate in relation to the supplemental surrounding sleeve 43.

Preferably, in the alternate embodiment shown in FIGS. 17-20, the coupler 8 has a first end 22 and a second end 23, a first coupling aperture 24 at the first end 22 and a second coupling aperture 25 at the second end 23. The first elongated tension member 2 is inserted in the first coupling aperture 24 and the second elongated tension member 5 is inserted in the second coupling aperture 25.

The proximal end 3 of the first elongated tension member 2 is preferably at least partially formed with a thread 26 where the coupler 8 attaches to the first elongated tension member 2. The proximal end 6 of the second elongated tension member 5 is preferably at least partially formed with a thread 27 where the coupler 8 attaches to the second elongated tension member 5. The coupler 8 preferably attaches to the first and second elongated tension members 2 and 5 by means of internally threaded portions 28 and 29 on the first and second coupling apertures 24 and 25 that mate with the threads 26 and 27 of the first and second elongated tension members 2 and 5, respectively.

Preferably, the first rotational member 15 is provided with a first end connection member 50. The first end connection member 50 has a central cavity 51. At least a portion of the central cavity 51 is formed as a substantially cylindrical inner surface 52 and at least a portion of the cylindrical inner surface 52 is formed with an internal thread 53. The internal thread 53 of the cylindrical inner surface 52 of the first end connection member 51 preferably receives the thread 26 of the proximal end 3 of the first elongated tension member 2.

As shown in FIG. 18, in this alternate embodiment, preferably, the second rotational member 54 is provided with a second end connection member 34. The second end connection member 34 preferably has a proximal end 35 and a distal end 36, and a central cavity 37. At least a portion of the central cavity 37 is formed as a substantially cylindrical inner surface 38 and at least a portion of the cylindrical inner surface 38 is formed with an internal thread 39. Preferably, the internal thread 39 of the cylindrical inner surface 38 of the second end connection member 34 receives the thread 27 of the proximal end 6 of the second elongated tension member 5.

Figure 4:
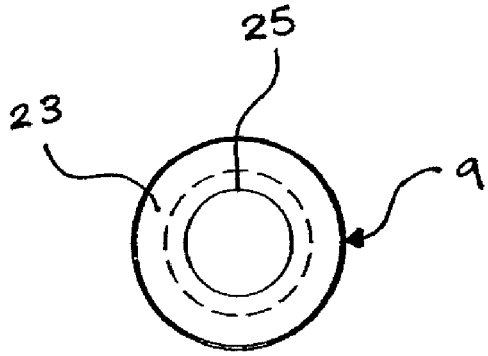
FIG. 4 is a top plan view of a surrounding sleeve of a coupler formed in accordance with the present invention and having a single surrounding sleeve.

As shown in FIG. 4, the distal end 4 of the first elongated tension member 2 is preferably connected to a structural member 57 in a building 58. Preferably, the building 58 has a structural frame 59 at least a portion of which is made from wood.

Preferably, in the preferred embodiment shown in FIGS. 1-11, the surrounding sleeve 20 rotates in relation to the first rotational member 15. Alternatively, in the embodiment shown in FIGS. 12-16, the first rotational member 15 rotates with respect to the surrounding sleeve 9 and the supplemental surrounding sleeve 43.

There are five preferred models of the coupler 8 of the present invention, the ATS-CTUD55, ATS-CTUD77, ATS-CTUD75, ATS-CTUD99 and ATS-CTUD97. The surrounding sleeves 9 and first rotational members 15 of all five models are preferably formed from ASTM A311 Class B, Grade 1144 steel, with a minimum tensile strength of 126,000 psi (869 MPa), and minimum yield strength of 105,000 psi (724 MPa). The torsion spring 20 is preferably formed from ASTM A313, Type 631 stainless steel torsional wire. The ATS-CTUD55, ATS-CTUD77 and ATS-CTUD75 torsion springs 20 are preferably formed from 0.110 inch (2.8 mm) wire. The ATS-CTUD99 and ATS-CTUD97 torsion springs 20 are preferably formed from 0.115 inch (2.9 mm) wire. All five models are preferably coated for corrosion protection when exposed to moisture; the preferred coating is a manganese phosphate finish.

The ATS-CTUD55 coupler 8 preferably couples a first elongated tension member 2 that is ⅝ inch in diameter and a second elongated tension member 5 that is ⅝ inch in diameter; the ATS-CTUD55 is preferably 1 ⅞ inches in diameter and 5 inches long and has an allowable tension capacity of 15,520 pounds. The ATS-CTUD77 coupler 8 preferably couples a first elongated tension member 2 that is ⅞ inch in diameter and a second elongated tension member 5 that is ⅞ inch in diameter; the ATS-CTUD77 is preferably 2 inches in diameter and 5 ½ inches long and has an allowable tension capacity of 31,795 pounds. The ATS-CTUD75 coupler 8 preferably couples a first elongated tension member 2 that is ⅞ inch in diameter and a second elongated tension member 5 that is ⅝ inch in diameter—a reducing coupler; the ATS-CTUD75 is preferably 2 inches in diameter and 5 ½ inches long and has an allowable tension capacity of 31,795 pounds. The ATS-CTUD99 coupler 8 preferably couples a first elongated tension member 2 that is 1 ⅛ inches in diameter and a second elongated tension member 5 that is 1 ⅛ inches in diameter; the ATS-CTUD99 is preferably 2 ½ inches in diameter and 6 ⅛ inches long and has an allowable tension capacity of 55,955 pounds. The ATS-CTUD97 coupler 8 preferably couples a first elongated tension member 2 that is 1 ⅛ inches in diameter and a second elongated tension member 5 that is ⅞ inch in diameter—a reducing coupler; the ATS-CTUD97 is preferably 2 ½ inches in diameter and 6 ⅛ inches long and has an allowable tension capacity of 55,955 pounds. Allowable tension capacities are based on ultimate loads divided by a safety factor of 3 and do not include a 33 percent steel stress increase. The threads 26 and 27 of the first and second elongated tension members 2 and 5, respectively, are both preferably UNC Class 2A.

Preferably, the distal end 17 of the first rotational member 15 is threaded onto the first elongated tension member 2, which is preferably the one of the first and second elongated tension members 2 and 5 that is below the coupler 8. The first rotational member 15 is preferably threaded onto the first elongated tension member 2 until the first elongated tension member 2 reaches the positive stop 60 in the first rotational member 15 and can be fully seen in the witness holes 61 in the first rotational member 15. The activation pins 62 at each end of the locking clip 21 are preferably facing out. Then the second elongated tension member 5 is preferably threaded into the connection end 10 of the surrounding sleeve 9 until the second elongated tension member 5 reaches the positive stop 60 in the surrounding sleeve 9. The activation pins 62 are not removed until the entire system is installed and inspection of the thread engagements has been completed. Couplers 8 are installed at each level until the run is complete. After the run has been completed and thread engagement has been inspected, the tie wire 63 and activation pins 62 are removed from each coupler 8.

An alternate preferred embodiment of the coupler 8 of the present invention is shown in FIGS. 17 through 21. In this alternate preferred embodiment, the coupler 8 includes a first coupler nut 64 and a second coupler nut 65. The first end 22 of the coupler 8 is located on the first coupler nut 64, and the second end 23 of the coupler 8 is located on the second coupler nut 65. The thread 26 of the proximal end 3 of the first elongated tension member 2 is turned into the first internally threaded portion 28 accessible through the first coupling aperture 24 located in the first end 22 of the coupler 8. The thread 27 of the proximal end 6 of the second elongated tension member 5 is turned into the second internally threaded portion 29 accessible through the second coupling aperture 25 located in the second end 23 of the coupler 8. The thread 19 on the substantially cylindrical outer surface 18 at the distal end 17 of the first rotational member 15 is turned into the first internally threaded portion 28 of the first coupling aperture 24 opposite the first elongated tension member 2. The thread 56 on the substantially cylindrical outer surface 55 of the second rotational member 54 is turned into the second internally threaded portion 29 of the second coupling aperture 26 opposite the second elongated tension member 5. Preferably, the first rotational member 15 includes a circumferential stop 66 that is diametrically larger than the substantially cylindrical outer surface 18 of the first rotational member 15. A plate member 67, with a first aperture 68 that accepts and fits the substantially cylindrical outer surface 18 of the first rotational member 15, is slipped over the proximal end 16 of the first rotational member 15 and slips down until it reaches the circumferential stop 66. The plate member 67 preferably includes a second aperture 69 that accepts the threaded end 71 of spring-retaining pin 70. The threaded end 71 passes through the second aperture 69 and is held in place by a nut 72. In this alternate embodiment, the surrounding sleeve 9 is a spindle around which one end of a flat torsion spring 20 is wound. The other end of the flat torsion spring 20 is wound around the spring-retaining pin 70 in the opposite orientation from the winding around the surrounding sleeve 9, so that the flat torsion spring 20 forms a compound S-curve. The torsion spring 20 is centered and aligned on the surrounding sleeve 9 by a pair of circumferential discs 73, one of which is retained on the surrounding sleeve 9 by an enlarged nut 74 that is screwed onto the first rotational member 15. The circumferential discs 73 also anchor one end of the torsion spring 20. The thread 14 at the take-up end 11 of the substantially cylindrical inner surface 13 of the central bore 12 of the surrounding sleeve 9 is screwed down on the proximal end 16 of the first rotational member 15. The thread 56 of the second rotational member 55 is screwed into the thread 14 at the connection end 10 of the substantially cylindrical inner surface 13 of the central bore 12 of the surrounding sleeve 9.

We claim:

1. A connection (1), comprising:

a. a first elongated tension member (2) having a proximal end (3) and a distal end (4), the first elongated tension member (2) being anchored at the distal end (4);

b. a second elongated tension member (5) having a proximal end (6) and a distal end (7), the second elongated tension member (5) being anchored at the distal end (7), and the proximal ends (3 and 6) of the first and second elongated tension members (2 and 5) being disposed in close proximity to each other;

c. a coupler (8) attached to the proximal ends (3 and 6) of the first and second elongated tension members (2 and 5), connecting the first and second elongated tension members (2 and 5) together, the coupler (8) comprising, 1. a surrounding sleeve (9), having a connection end (10) and a take-up end (11), and a central bore (12) wherein at least a portion of the central bore (12) is formed as a substantially cylindrical inner surface (13) and wherein at least a portion of the cylindrical inner surface (13) is formed with a thread (14);
2. a first rotational member (15) having a proximal end (16) and a distal end (17), the first rotational member (15) being received in the central bore (12) of the surrounding sleeve (9) and operatively connected to the surrounding sleeve (9), the first rotational member (15) having a substantially cylindrical outer surface (18) formed with a thread (19) that mates with the thread (14) of the cylindrical inner surface (13) of the surrounding sleeve (9) and is connected to the surrounding sleeve (9) only by the mating attachment of the thread (19) on the cylindrical outer surface (18) with the thread (14) of the surrounding sleeve (9), such that the first rotational member (15) can travel on the threads of the surrounding sleeve (9); and
3. a torsion spring (20) connecting the first rotational member (15) and the surrounding sleeve (9), the torsion spring (20) biasing the first rotational member (15) and the surrounding sleeve (9) in opposite rotational directions such that the first rotational member (15) can be drawn into the surrounding sleeve (9).

2. The connection (1) of claim 1, wherein the coupler (8) further comprises:

a locking clip (21) that is releasably attached to the coupler (8), the locking clip (21) holding the surrounding sleeve (9) and the first rotational member (15) in a selected relationship such that the first rotational member (15) cannot travel further into the surrounding sleeve (9) and thereby prevents the surrounding sleeve (9) and the first rotational member (15) from rotating under the influence of the torsion spring (20) and causing the coupler (8) to contract.

3. The connection (1) of claim 1, wherein:

the coupler (8) has a first end (22) and a second end (23), a first coupling aperture (24) at the first end (22) and a second coupling aperture (25) at the second end (23), the first elongated tension member (2) being inserted in the first coupling aperture (24) and the second elongated tension member (5) being inserted in the second coupling aperture (25).

4. The connection (1) of claim 3, wherein:

a. the proximal end (3) of the first elongated tension member (2) is at least partially formed with a thread (26) where the coupler (8) attaches to the first elongated tension member (2);

b. the proximal end (6) of the second elongated tension member (5) is at least partially formed with a thread (27) where the coupler (8) attaches to the second elongated tension member (5); and c. the coupler (8) attaches to the first and second elongated tension members (2 and 5) by means of a first internally threaded portion (28) accessible through the first coupling aperture (24) and a second internally threaded portion (29) accessible through the second coupling aperture (25) that mate with the threads (26 and 27) of the first and second elongated tension members (2 and 5), respectively.

5. The connection (1) of claim 4, wherein:

the first rotational member (15) has a central cavity (30) and at least a portion of the central cavity (30) of the first rotational member (15) is formed as a substantially cylindrical inner surface (31) and wherein at least a portion of the cylindrical inner surface (31) is formed with an internal thread (32).

6. The connection (1) of claim 5, the internal thread (32) of the cylindrical inner surface (31) of the first rotational member (15) receives the thread (26) of the proximal end (3) of the first elongated tension member (2).

7. The connection (1) of claim 6, wherein:

the internal thread (19) of the first rotational member (15), near the proximal end (16) of the first rotational member (15), is disturbed so that it is not possible for the proximal end (3) of the first elongated tension member (2), traveling on the internal thread (19), to travel past a selected point (33) near the proximal end (16) of the first rotational member (15).

8. The connection (1) of claim 4, wherein:

a second end connection member (34) is received at least partially inside the central bore (12) of the surrounding sleeve (9) and is operatively connected to the surrounding sleeve (9).

9. The connection (1) of claim 8, wherein:

the second end connection member (34) has a proximal end (35) and a distal end (36), and a central cavity (37) wherein at least a portion of the central cavity (37) is formed as a substantially cylindrical inner surface (38) and wherein at least a portion of the cylindrical inner surface (38) is formed with an internal thread (39).

10. The connection (1) of claim 9, the internal thread (39) of the cylindrical inner surface (38) of the second end connection member (34) receives the thread (27) of the proximal end (6) of the second elongated tension member (5).

11. The connection (1) of claim 10, wherein:

the internal thread (39) of the second end connection member (34), near the proximal end (35) of the second end connection member (34), is disturbed so that it is not possible for the proximal end (6) of the second elongated tension member (5), traveling on the internal thread (39), to travel past a selected point (40) near the proximal end (35) of the internal thread (39).

12. The connection (1) of claim 8, wherein:

the second end connection member (34) is prevented from withdrawing from the connection end (10) of the surrounding sleeve (9) by a shoulder (41) on the surrounding sleeve (9).

13. The connection (1) of claim 12, wherein:

the second end connection member (34) has a substantially cylindrical outer surface (42) where it is received within the surrounding sleeve (9) and the second end connection member (34) can freely rotate within the surrounding sleeve (9).

14. The connection (1) of claim 8, wherein:

the second end connection member (34) is completely received within the surrounding sleeve (9).

15. The connection (1) of claim 1, further comprising:

a. a supplemental surrounding sleeve (43), having a connection end (44) and a take-up end (45), and a central bore (46) wherein at least a portion of the central bore (46) is formed as a substantially cylindrical inner surface (47) and wherein at least a portion of the cylindrical inner surface (47) is formed with a thread (48);

b. the distal end (17) of the first rotational member (15) is received in the central bore (46) of the supplemental surrounding sleeve (43) and is operatively connected to the supplemental surrounding sleeve (43), the first rotational member (15) has a substantially cylindrical outer surface (18) formed with a thread (19) that mates with the thread (48) of the cylindrical inner surface (47) of the supplemental surrounding sleeve (43) and is connected to the supplemental surrounding sleeve (43) only by the mating attachment of the thread (19) on the cylindrical outer surface (18) with the thread (48) of the supplemental surrounding sleeve (43), such that the first rotational member (15) can rotate in relation to the supplemental surrounding sleeve (43); and c. a second torsion spring (49) connecting the first rotational member (15) and the supplemental surrounding sleeve (43), the torsion spring (49) biasing the first rotational member (15) and the supplemental surrounding sleeve (43) in opposite rotational directions such that the first rotational member (15) can be drawn into the supplemental surrounding sleeve (43).

16. The connection (1) of claim 15, wherein:

the coupler (8) has a first end (22) and a second end (23), a first coupling aperture (24) at the first end (22) and a second coupling aperture (25) at the second end (23), the first elongated tension member (2) being inserted in the first coupling aperture (24) and the second elongated tension member (5) being inserted in the second coupling aperture (25).

17. The connection (1) of claim 16, wherein:

a. the proximal end (3) of the first elongated tension member (2) is at least partially formed with a thread (26) where the coupler (8) attaches to the first elongated tension member (2);

b. the proximal end (6) of the second elongated tension member (5) is at least partially formed with a thread (27) where the coupler (8) attaches to the second elongated tension member (5); and c. the coupler (8) attaches to the first and second elongated tension members (2 and 5) by means of a first internally threaded portion (28) on the first coupling aperture (24) and a second internally threaded portion (29) on the second coupling aperture (25) that mate with the threads (26 and 27) of the first and second elongated tension members (2 and 5), respectively.

18. The connection (1) of claim 17, wherein:

the supplemental surrounding sleeve (43) is provided with a first end connection member (50), the first end connection member (50) having a central cavity (51) wherein at least a portion of the central cavity (51) is formed as a substantially cylindrical inner surface (52) and wherein at least a portion of the cylindrical inner surface (52) is formed with an internal thread (53).

19. The connection (1) of claim 18, the internal thread (53) of the cylindrical inner surface (52) of the first end connection member (50) receives the thread (26) of the proximal end (3) of the first elongated tension member (2).

20. The connection (1) of claim 17, wherein:

the surrounding sleeve (9) is provided with a second end connection member (34).

21. The connection (1) of claim 20, wherein:

the second end connection member (34) has a proximal end (35) and a distal end (36), and a central cavity (37) wherein at least a portion of the central cavity (37) is formed as a substantially cylindrical inner surface (38) and wherein at least a portion of the cylindrical inner surface (38) is formed with an internal thread (39).

22. The connection (1) of claim 21, the internal thread (39) of the cylindrical inner surface (38) of the second end connection member (34) receives the thread (27) of the proximal end (6) of the second elongated tension member (5).

23. The connection (1) of claim 1, further comprising:

a. a supplemental surrounding sleeve (43) connected to the surrounding sleeve (9), the supplemental surrounding sleeve (43) having a connection end (44) and a take-up end (45), and a central bore (46) wherein at least a portion of the central bore (46) is formed as a substantially cylindrical inner surface (47) and wherein at least a portion of the cylindrical inner surface (47) is formed with a thread (48); and b. a second rotational member (54) is received in the central bore (46) of the supplemental surrounding sleeve (43) and is operatively connected to the supplemental surrounding sleeve (43), the second rotational member (54) has a substantially cylindrical outer surface (55) formed with a thread (56) that mates with the thread (48) of the cylindrical inner surface (47) of the supplemental surrounding sleeve (43) and is connected to the supplemental surrounding sleeve (43) only by the mating attachment of the thread (56) on the cylindrical outer surface (55) with the thread (48) of the supplemental surrounding sleeve (43), such that the second rotational member (54) can rotate in relation to the supplemental surrounding sleeve (43).

24. The connection (1) of claim 23, wherein:

the coupler (8) has a first end (22) and a second end (23), a first coupling aperture (24) at the first end (22) and a second coupling aperture (25) at the second end (23), the first elongated tension member (2) being inserted in the first coupling aperture (24) and the second elongated tension member (5) being inserted in the second coupling aperture (25).

25. The connection (1) of claim 23, wherein:

a. the proximal end (3) of the first elongated tension member (2) is at least partially formed with a thread (26) where the coupler (8) attaches to the first elongated tension member (2);

b. the proximal end (6) of the second elongated tension member (5) is at least partially formed with a thread (27) where the coupler (8) attaches to the second elongated tension member (5); and c. the coupler (8) attaches to the first and second elongated tension members (2 and 5) by means of internally threaded portions (28 and 29) on the first and second coupling apertures (24 and 25) that mate with the threads (26 and 27) of the first and second elongated tension members (2 and 5), respectively.

26. The connection (1) of claim 25, wherein:

the first rotational member (15) is provided with a first end connection member (50), the first end connection member (50) having a central cavity (51) wherein at least a portion of the central cavity (51) is formed as a substantially cylindrical inner surface (52) and wherein at least a portion of the cylindrical inner surface (52) is formed with an internal thread (53).

27. The connection (1) of claim 26, the internal thread (53) of the cylindrical inner surface (52) of the first end connection member (51) receives the thread (26) of the proximal end (3) of the first elongated tension member (2).

28. The connection (1) of claim 25, wherein:

the second rotational member (54) is provided with a second end connection member (34).

29. The connection (1) of claim 28, wherein:

the second end connection member (34) has a proximal end (35) and a distal end (36), and a central cavity (37) wherein at least a portion of the central cavity (37) is formed as a substantially cylindrical inner surface (38) and wherein at least a portion of the cylindrical inner surface (38) is formed with an internal thread (39).

30. The connection (1) of claim 29, the internal thread (39) of the cylindrical inner surface (38) of the second end connection member (34) receives the thread (27) of the proximal end (6) of the second elongated tension member (5).

31. The connection (1) of claim 1, wherein:

a. the distal end (4) of the first elongated tension member (2) is connected to a structural member (57) in a building (58).

32. The connection (1) of claim 31, wherein:

the building (58) has a structural frame (59) at least a portion of which is made from wood.

33. The connection (1) of claim 1, wherein:

said first rotational member (15) allows said surrounding sleeve (9) to rotate relative to said first rotational member (15).

34. The connection (1) of claim 1, wherein:

said first rotational member (15) rotates relative to said surrounding sleeve (9).

* * * * *